US009045929B2

(12) United States Patent
Shibata

(10) Patent No.: US 9,045,929 B2
(45) Date of Patent: Jun. 2, 2015

(54) OPEN-CLOSE MEMBER CONTROL APPARATUS AND METHOD FOR CONTROLLING OPEN-CLOSE MEMBER

(71) Applicant: ASMO CO., LTD., Kosai, Shizuoka-pref. (JP)

(72) Inventor: Kazuyuki Shibata, Kosai (JP)

(73) Assignee: ASMO CO., LTD., Shizuoka-pref. (JP)

( * ) Notice: Subject to any disclaimer, the term of this patent is extended or adjusted under 35 U.S.C. 154(b) by 0 days.

(21) Appl. No.: 13/905,181

(22) Filed: May 30, 2013

(65) Prior Publication Data

US 2013/0340341 A1 Dec. 26, 2013

(30) Foreign Application Priority Data

Jun. 22, 2012 (JP) ..... 2012-141275
Jul. 27, 2012 (JP) ..... 2012-167177

(51) Int. Cl.
*E05F 15/02* (2006.01)
*E05F 15/20* (2006.01)

(52) U.S. Cl.
CPC ..... *E05F 15/20* (2013.01); *E05F 15/40* (2015.01); *E05F 15/695* (2015.01); *E05F 15/697* (2015.01); *E05F 15/77* (2015.01)

(58) Field of Classification Search
CPC ..... E05F 15/20; E05F 15/40; E05F 15/695; E05F 15/77; E05F 15/697
USPC ..... 49/26, 28, 502, 348, 349, 350, 351; 318/443, 266, 282, 471, 445, 286
See application file for complete search history.

(56) References Cited

U.S. PATENT DOCUMENTS

| | | | | | |
|---|---|---|---|---|---|
| 4,055,023 | A * | 10/1977 | Gatland et al. | 49/28 |
| 4,159,598 | A * | 7/1979 | Gatland et al. | 49/28 |
| 4,981,084 | A * | 1/1991 | Templeton et al. | 105/341 |
| 5,537,013 | A * | 7/1996 | Toyozumi et al. | 318/283 |
| 6,505,127 | B1 | 1/2003 | Togami | |
| 6,925,755 | B1 * | 8/2005 | Kyrtsos | 49/26 |
| 8,564,227 | B2 * | 10/2013 | Stroger | 318/127 |
| 2007/0107313 | A1 * | 5/2007 | Suzuki et al. | 49/360 |
| 2012/0192489 | A1 * | 8/2012 | Pribisic | 49/28 |
| 2014/0083011 | A1 * | 3/2014 | Sumiya | 49/28 |

FOREIGN PATENT DOCUMENTS

| | | | |
|---|---|---|---|
| JP | 08-260810 | A | 10/1996 |
| JP | 2011-122369 | A | 6/2011 |

* cited by examiner

*Primary Examiner* — Jerry Redman
(74) *Attorney, Agent, or Firm* — Posz Law Group, PLC

(57) ABSTRACT

An open-close member control apparatus is to prevent a foreign matter from being trapped to a window glass serving as an open-close member that is driven to open by manipulation of a manipulation switch. When a trapping detection section determines that the foreign matter is trapped to the window glass, power supply to a driving device is stopped to stop opening of the window glass. Then, it is determined whether a predetermined condition is satisfied for approving re-open of the window glass. When the predetermined condition is satisfied, the power supply to the driving device is re-started. Opening of the window glass is thereby enabled again.

20 Claims, 13 Drawing Sheets

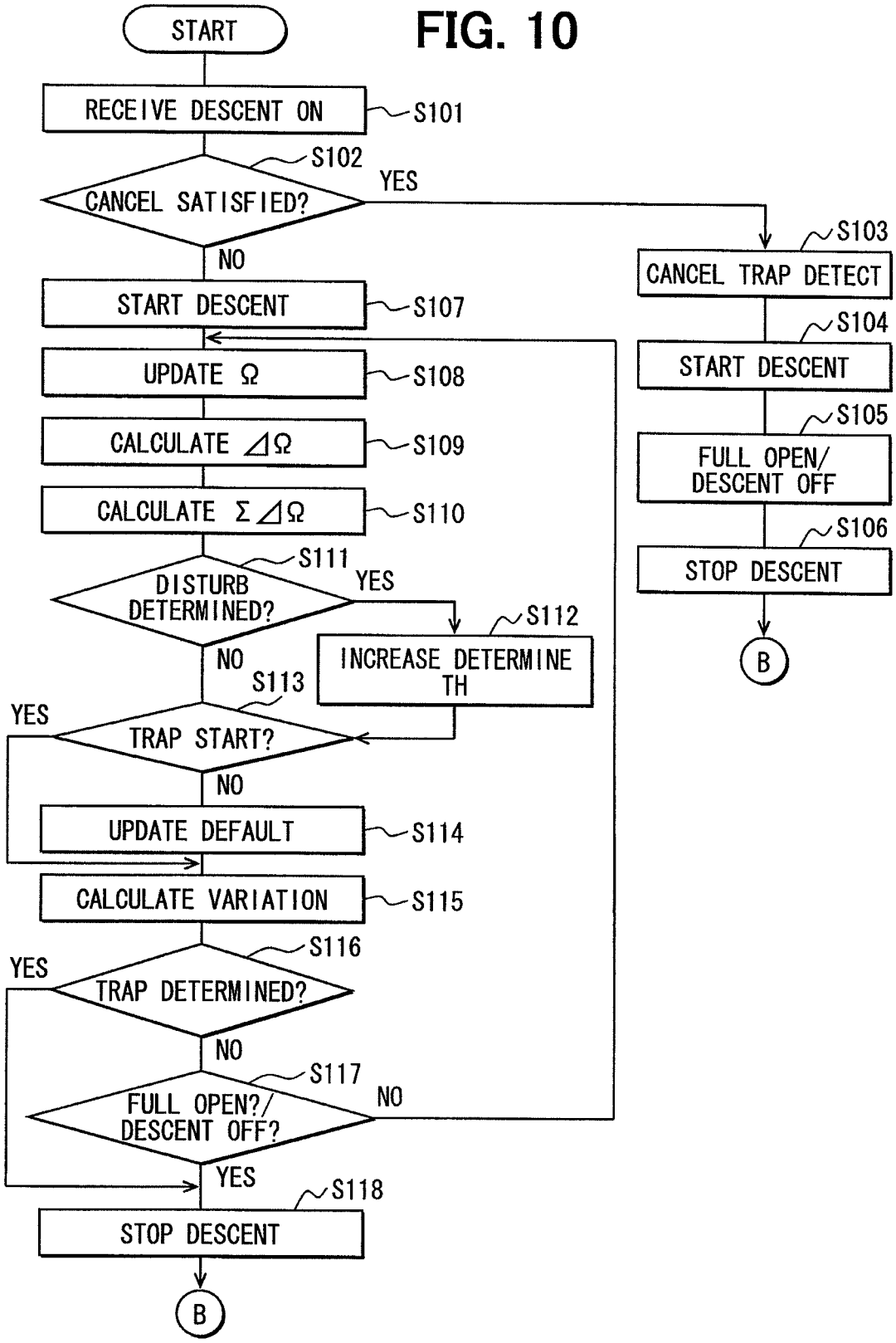
FIG. 10
START
RECEIVE DESCENT ON
S101
S102
CANCEL SATISFIED?
YES
NO
S103
CANCEL TRAP DETECT
S104
START DESCENT
S105
FULL OPEN/ DESCENT OFF
S106
STOP DESCENT
B
START DESCENT
S107
UPDATE Ω
S108
CALCULATE ⊿Ω
S109
CALCULATE Σ⊿Ω
S110
S111
DISTURB DETERMINED?
YES
NO
S112
INCREASE DETERMINE TH
S113
TRAP START?
YES
NO
UPDATE DEFAULT
S114
CALCULATE VARIATION
S115
S116
TRAP DETERMINED?
YES
NO
S117
FULL OPEN?/ DESCENT OFF?
NO
YES
S118
STOP DESCENT
B START
SET HIGH SENSITIVE
S131
RECEIVE DESCENT ON
S132
S133
ALLEVIATION SATISFIED?
YES
S134
SET LOW SENSITIVE
NO
START DESCENT
S135
UPDATE Ω
S136
CALCULATE ⊿Ω
S137
CALCULATE Σ⊿Ω
S138
S139
DISTURB DETERMINED?
YES
S140
UP DETERMINE TH
NO
S141
YES
TRAP START?
NO
UPDATE DEFAULT
S142
CALCULATE VARIATION
S143
S144
YES
TRAP DETERMINED?
NO
S145
FULL OPEN?/ DESCENT OFF?
NO
YES
STOP DESCENT
S146
B

OPEN-CLOSE MEMBER CONTROL APPARATUS AND METHOD FOR CONTROLLING OPEN-CLOSE MEMBER

CROSS REFERENCE TO RELATED APPLICATION

The present application is based on Japanese Patent Applications No. 2012-141275 filed on Jun. 22, 2012, and NO. 2012-167177 filed on Jul. 27, 2012, the disclosure of which is incorporated herein by reference.

TECHNICAL FIELD

The present disclosure relates to an open-close member control apparatus and a method for controlling an open-close member; in particular, the apparatus and the method are suitably applied in a vehicle when detecting a foreign matter that is trapped between a window glass serving as the open-close member and a belt molding in cases that the window glass is operated to open or descend.

BACKGROUND ART

[Patent Literature 1] JP H08-260810 A

[Patent Literature 2] WO 99/42691 (U.S. Pat. No. 6,505,127 B1)

[Patent Literature 3] JP 2011-122369 A

A conventional open-close member control apparatus such as a power window provides a technology, which stores predetermined data such as a motor rotation cycle/velocity in a storage unit, and detects a load of pinching based on increase and decrease of the motor rotation cycle/velocity using a microcomputer, for the purpose of protecting a foreign matter that is pinched or inserted (Patent Literatures 1, 2).

In addition, when a belt molding itself is trapped by the window glass at the time of open movement of a window glass functioning as an open-close member, a load larger than usual is added to a motor. When the large load continues, the damage is given to the motor, posing an anomaly of generating an unusual sound and lowering a movement speed. There is proposed a technology to prevent such anomaly while eliminating trouble of damaging a foreign matter when the foreign matter is trapped between the belt molding and the window glass (Patent Literature 3).

Patent Literatures 1, 2 disclose a function to prevent pinching, but do not disclose a function to prevent trapping at the time of open movement of a window glass functioning as an open-close member. Patent Literature 3 discloses an open-close member control apparatus and its control method, which have a function to prevent trapping of an open-close member and provide a measure to respond to the trapping of a foreign matter that is trapped when the window glass is under the open movement.

However, such measure is configured to stop the window glass when detecting of the trapping of a foreign matter. A sliding loss between a window glass and a belt molding may be increased by deformation of the belt molding or decline of atmospheric temperature; an anomaly such as a gap or hanging in an open-close apparatus may arise during running of a vehicle; or a secular change may arise in a system such as a power window. Such factors may pose an increase of sliding load, which may result in mistakenly detecting trapping although such trapping does not occur and, thereby, needing to stop open movement of the open-close member. When such mis-detection arises, the window glass as an open-close member stops frequently; this degrades manipulability of an open-close member control apparatus.

In addition, although the detection of trapping during the descent (open movement) of the open-close member stops the open-close member, there are some cases that need to certainly continue the open movement when the open-close member is required to be certainly moved down or opened to a predetermined position in predetermined conditions or switch manipulation, for instance: an open movement up to a predetermined position to release pinching after detecting the pinching during open-close movement; an open movement of the open-close member at the time of escaping from a submerged vehicle; an open movement of the open-close member based on the intention of a user; and an open movement by manipulation of a radio equipment from an outside of a vehicle in the state where no person is present in the vehicle compartment. Those cases do not have much trouble even when the open movement is given a priority. Therefore, an open-close member control apparatus is desired which certainly permits open movement in the above various cases while preventing trapping.

SUMMARY

It is a first object of the present disclosure to provide an open-close member control apparatus and a method for controlling an open-close member; the apparatus and the method have a function to prevent trapping during an open movement of the open-close member while certainly continuing the open movement even with mis-detection of trapping, thereby preventing decline in manipulability. Further, the apparatus and the method re-start an open movement when confirming mis-detection of trapping even after the open movement was stopped by such mis-detection of trapping.

It is a second object to provide an open-close member control apparatus, which has a prevention device to prevent trapping in an open movement of an open-close member while preventing an incorrect stop during the open movement of the open-close member in a predetermined condition, thereby certainly achieving an open movement of the open-close member.

To achieve the above first object, according to an example of the present disclosure, an open-close member control apparatus is provided to prevent a foreign matter from being trapped to an open-close member that is driven to open based on manipulation of a manipulation switch. The apparatus includes: a driving device which drives open movement or close movement of the open-close member; a control device which controls actuation of the driving device; a movement detection device which outputs a movement state signal according to a movement state of the open-close member that is driven to open or close by the driving device; and a trapping detection section which performs trapping detection to detect trapping of the foreign matter to the open-close member based on the movement state signal. Further, the trapping detection section further determines affirmatively or negatively the trapping of the foreign matter to the open-close member based on a result of comparing the movement state signal outputted by the movement detection device with a trapping determination threshold. The control device stops electric power supply to the driving device when the trapping detection section determines affirmatively the trapping of the foreign matter, permitting stop of open movement of the open-close member. The control device starts, under a predetermined re-open condition, electric power supply to the driving device based on manipulation of the manipulation switch in a condition-alleviated state, permitting re-start of open movement of the open-close member. The condition-alleviated state uses a second trapping detection condition, which is alleviated from a first trapping detection condition used before and when the trapping detection determines affirmatively the trapping.

Further, to achieve the above first object, according to another example of the present disclosure, a method is provided for controlling an open-close member in the open-close member control apparatus according to the above example. The method includes: determining affirmatively or negatively the trapping of the foreign matter to the open-close member based on a result of comparing the movement state signal outputted by the movement detection device with a trapping determination threshold; stopping an electric power supply to the driving device when the trapping of the foreign matter is determined affirmatively, permitting stop of open movement of the open-close member; and starting, under a predetermined re-open condition, an electric power supply to the driving device based on manipulation of the manipulation switch in the condition-alleviated state, permitting re-start of open movement of the open-close member.

Further, to achieve the above second object, according to an example of the present disclosure, an open-close member control apparatus is provided to perform open movement or close movement of an open-close member based on manipulation of a switch or a signal from a control circuit in a vehicle. The apparatus includes a control device to perform trapping prevention, which prevents a foreign matter from being trapped to the open-close member that is under the open movement. The control device includes (i) a cancellation section to cancel a trapping detection, which is made to perform the trapping prevention, or (ii) an alleviation section to alleviate a condition of the trapping detection. In cases that the control device recognizes a predetermined condition when an open movement is required to the open-close member, the control device causes (i) the cancellation section to cancel the trapping detection or (ii) the alleviation section to alleviate the condition of the trapping detection.

Yet further, to achieve the above second object, according to another example of the present disclosure, an open-close member control apparatus is provided to prevent a foreign matter from being trapped to an open-close member that is driven to open based on manipulation of a switch or a signal from a control circuit in a vehicle. The apparatus includes: a driving device which drives open movement or close movement of the open-close member; a control device which controls actuation of the driving device; a movement detection device which outputs a movement state signal according to a movement state of the open-close member that is driven to open or close by the driving device; and a trapping detection section which performs trapping detection to detect trapping of the foreign matter to the open-close member based on the movement state signal. The trapping detection section further determines affirmatively or negatively the trapping of the foreign matter to the open-close member based on a result of comparing the movement state signal outputted by the movement detection device with a trapping determination threshold. The control device includes (i) a cancellation section to cancel the trapping detection or (ii) an alleviation section to alleviate the trapping determination threshold in determining affirmatively or negatively the trapping. When, under a predetermined condition, an open movement is required to the open-close member, the control device causes (i) the cancellation section to cancel the trapping detection or (ii) the alleviation section to alleviate the trapping determination threshold.

BRIEF DESCRIPTION OF THE DRAWINGS

The above and other objects, features, and advantages of the present disclosure will become more apparent from the following detailed description made with reference to the accompanying drawings. In the drawings:

FIG. 10 is a flowchart diagram illustrating trapping determination and trapping detection cancellation according to a second embodiment of the present disclosure;

DETAILED DESCRIPTION

First Embodiment

A power window apparatus 1 (hereinafter "the apparatus 1") as an open-close member control apparatus according to a first embodiment of the present disclosure will be explained with reference to FIGS. 1 to 9.

Figure 1:
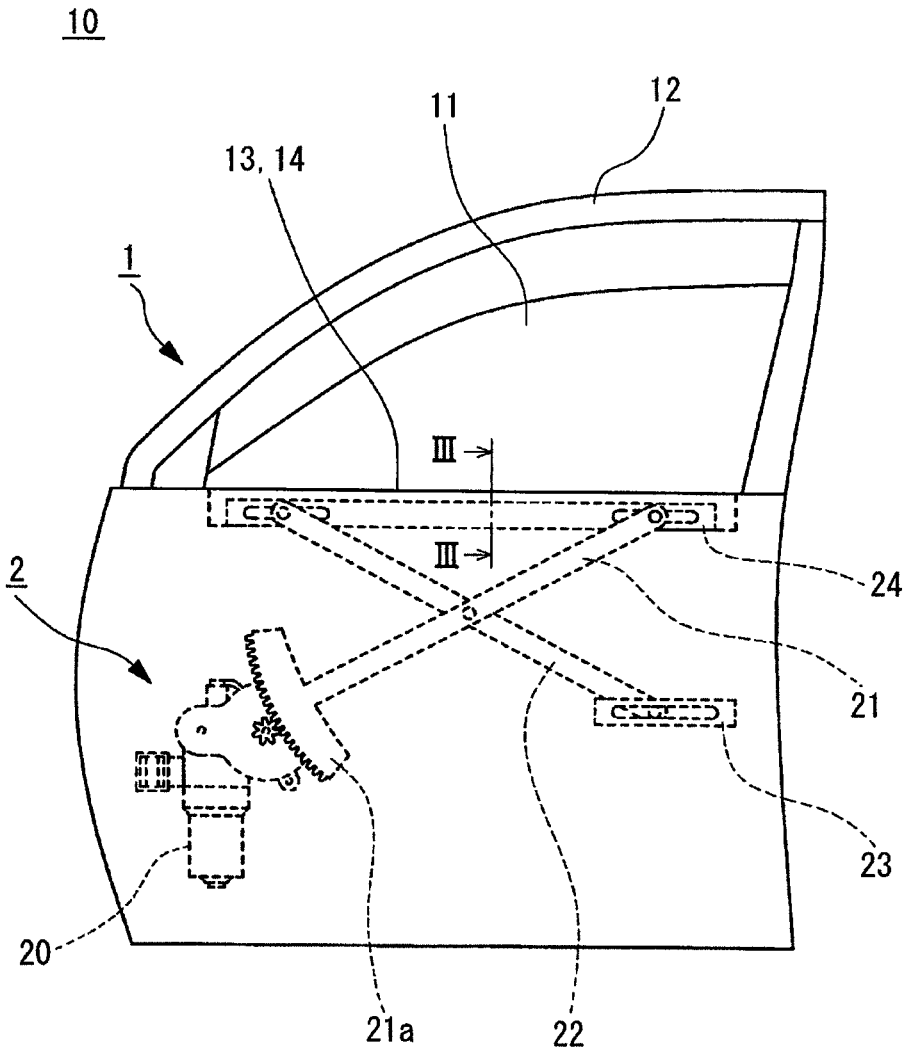
FIG. 1 is a diagram for explaining a power window apparatus as an open-close control apparatus according to embodiments of the present disclosure.
Figure 2:
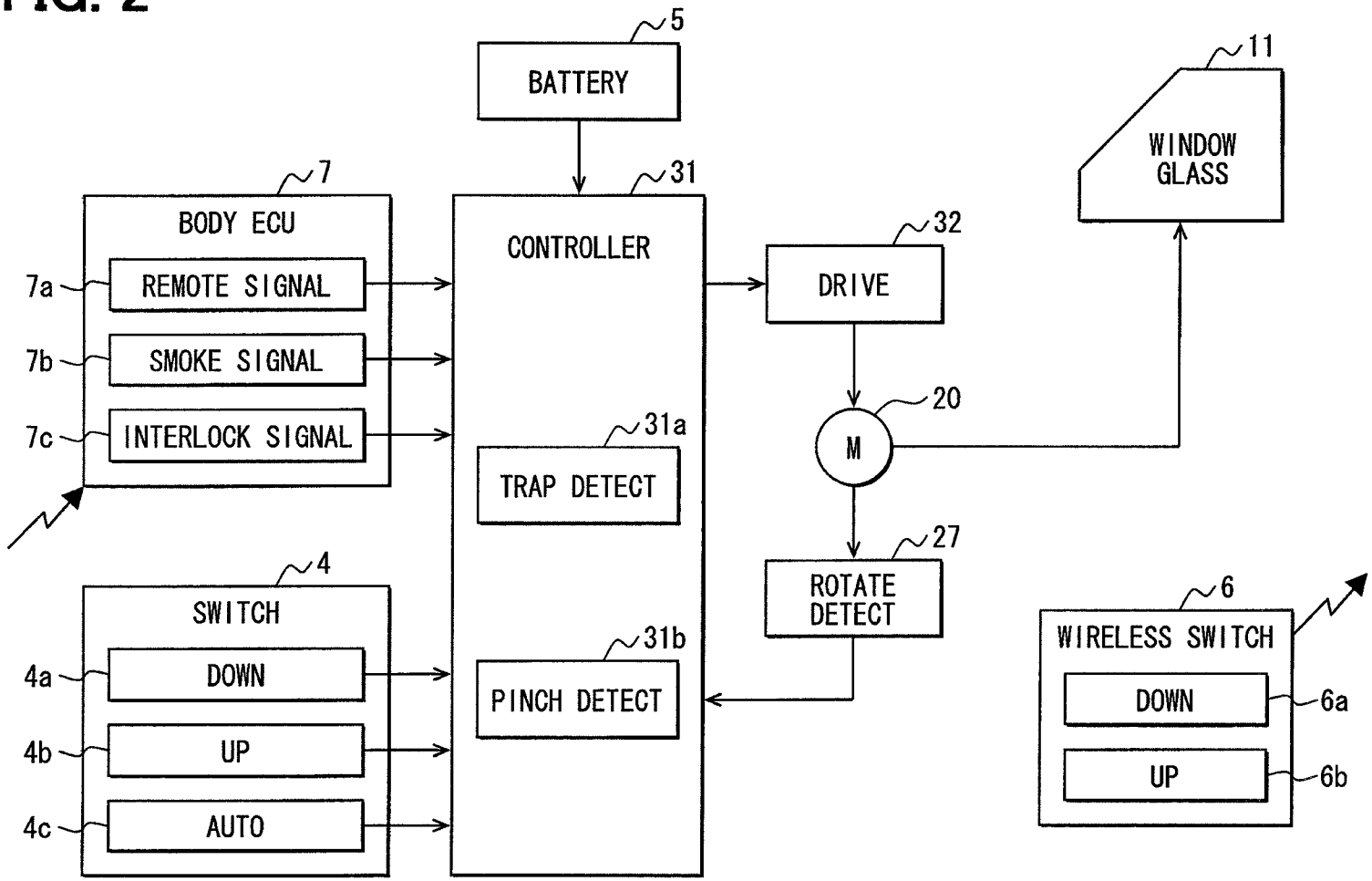
FIG. 2 is an electric block diagram of the power window apparatus of FIG. 1.

With reference to FIGS. 1, 2, the apparatus 1 of the present embodiment includes the following: a driving means or device 2 which performs an open-close drive or open-close movement of a window glass 11 serving as an open-close member provided in a door 10 of a vehicle; a controller 31, which is mainly included in a control means or device 3, for controlling actuation of the driving device 2 and performing various detections and computations; and a switch 4 (down switch 4*a*, up switch 4*b*, auto switch 4*c*) and a wireless signal switch 6 (down switch 6*a*, up switch 6*b*), which are also referred to as a manipulation switch and used by an occupant of the vehicle for requiring actuation of the driving device 2 or movement of the window glass 11. The driving device 2 includes a motor 20 and performs an up-down movement (i.e., open-close movement) of a window glass 11 by rotation drive of the motor 20.

Figure 3:
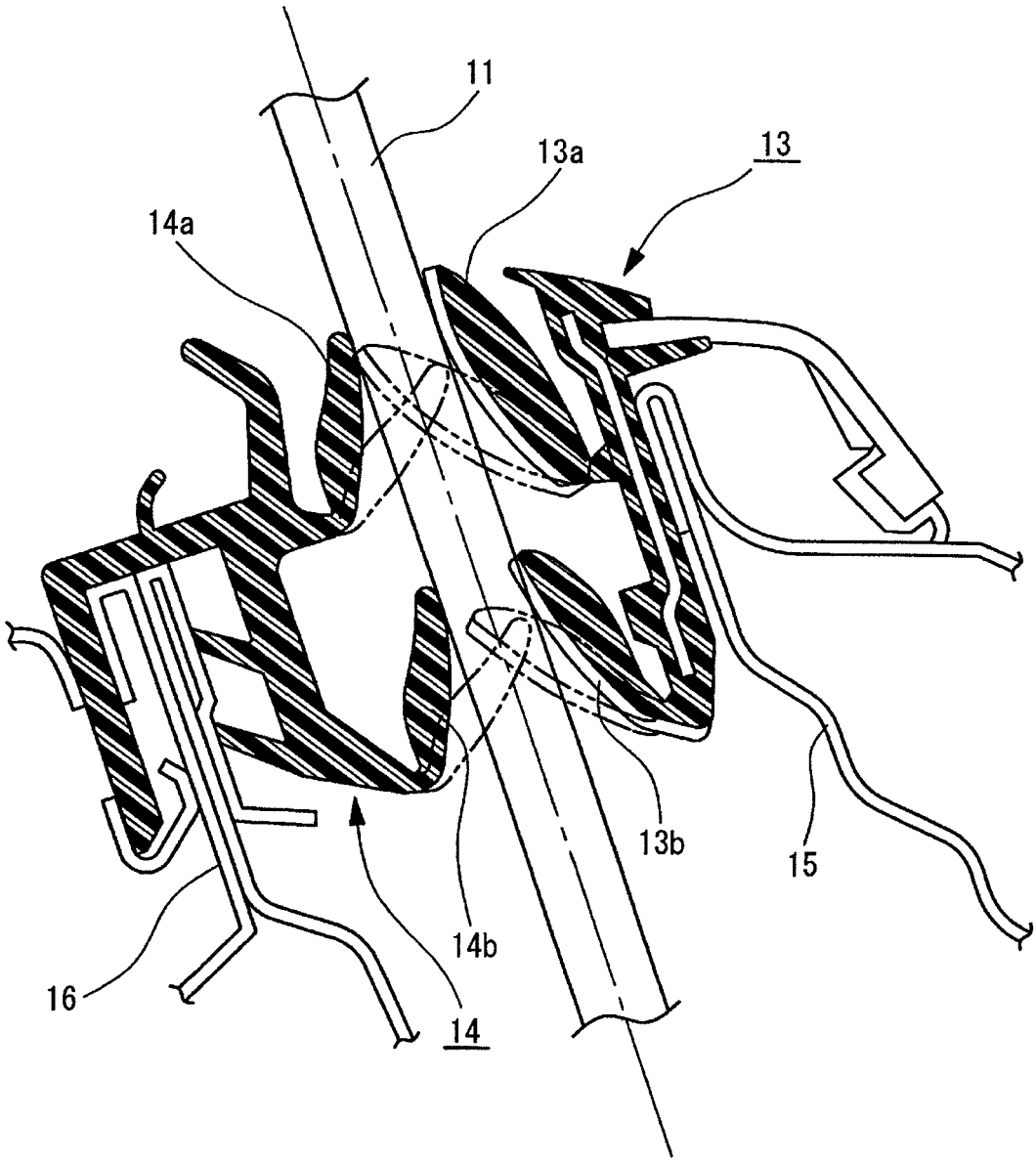
FIG. 3 is a cross-sectional diagram taken from line in FIG. 1.

With reference to FIG. 3, the door 10 has an storage space in a lower portion of the door 10 (i.e., under a beltline of the vehicle) to store a window glass 11 which is lowered; the storage space is provided between an outer panel 15 arranged on a vehicle exterior side (an outside of the vehicle in a width direction) and an inner panel 16 arranged on a vehicle interior side (an inside of the vehicle in the width direction. Further, as illustrated in FIG. 1, the door 10 has a window frame (glass frame) 12 in an upper portion; the window glass 11 is heightened or ascends beyond a lower frame portion of the window frame 12 to thereby appear from the storage space into an inside area of the window frame 12, thereby undergoing open-close or down-up movement. The lower frame portion of the window frame 12 is equipped with outer and inner belt moldings (i.e., beltline molding) 13, 14 that serve as sealing members as indicated in FIG. 3. The outer molding 13 is fixed to an upper portion of the outer panel 15; the inner molding 14 is fixed to an upper portion of the inner panel 16.

The window glass 11 passes or moves through a gap between the outer molding 13 and the inner molding 14, and undergoes an up-down movement inside of the window frame 12. The outer molding 13 and the inner molding 14 include seal projections 13*a*, 13*b*, 14*a*, 14*b* projected to the window glass 11, respectively; these seal projections 13*a*, 13*b*, 14*a*, 14*b* are press-fitted to glass surfaces of the window glass 11 elastically.

In addition, the upper frame portion of the window frame 12 is similarly equipped with a weather strip (i.e., upper molding) as a sealing member (unshown). The weather strip is provided, in its lower end, with a groove that opens downwardly. The groove is formed to accommodate or receive an uppermost end of the window glass 11 by a predetermined length. The glass surface of the received uppermost end of the window glass 11 is press-fitted to the inner wall of the groove. In the present embodiment, the window glass 11 undergoes an up-down movement of moving (i.e., ascending and descending) between a high fully-closed position (uppermost end) and a low fully-opened position (downmost end) according a predetermined rule.

With reference to FIG. 1, the driving device 2 of the present embodiment includes a motor 20 which is fixed to the door 10 and has a deceleration mechanism and a driving mechanism. The driving mechanism mainly includes the following: an up-down arm 21 equipped with a fan-shaped or sector-shaped gear 21*a* driven by the motor 20; a driven arm 22 pivotally intersecting with the up-down arm 21; a fixed channel 23 fixed to the door 10; and a glass-side channel 24 integrated with the window glass 11.

The motor 20 of the present embodiment receives electric power supply from a battery 5 via the controller 31 and a drive circuit 32, which are mentioned later; thereby, the winding of the rotator of the motor 20 receives electric current. This generates a magnetic attraction function between the rotator and a stator having a magnet, permitting forward and reverse rotation of the rotator. In the driving device 2 of the present embodiment, the rotation of the motor 20 swing the up-down arm 21 and the driven arm 22; the ends of the arms 21 and 22 slide under restriction by the channels 23 and 24 and are driven as an X link. This permits an up-down movement of the window glass 11.

The motor 20 is equipped with a rotation detection unit 27 as a movement detection means or device or a movement speed detection means or device, which is integrated into the motor 20 as one body. The rotation detection unit 27 outputs pulse signals (speed detection signals or movement state signal), which is synchronized with rotation of the motor 20, to the controller 31. The rotation detection unit 27 is to detect a magnetic variation of the magnet rotated along with the output shaft of the motor 20 using a plurality of hall elements.

Under such a configuration, the rotation detection unit 27 outputs the pulse signals in synchronization with the rotation of the motor 20. That is, the pulse signals are outputted for respective predetermined movement quantities of the window glass 11 or respective predetermined angles of rotation of the motor 20. Thereby, the rotation detection unit 27 can output the signals according to the movement of the window glass 11, which are approximately proportional to the rotation speeds of the motor 20. Upon receiving the pulse signals from the rotation detection unit 27, the controller 31 counts pulse edges of the pulse signals, and detects the position of the window glass 11 from a pulse count value. In the present embodiment, the rotation detection unit 27 and the controller 31 may thus function as a position detection means or device.

In the present embodiment, the rotation detection unit 27 includes the hall elements; however, there is no need to be limited thereto. As long as the rotation of the motor 20 is detectable, an encoder may be adopted. In addition, ripple current is generated when electric current applied to the winding of the motor is switched. The waveform of the ripple current may be detected; this permits detection of a rotation number or rotational position of the motor (i.e., position of the open-close member). In the present embodiment, the rotation detection unit 27 is provided in the motor 20 so as to detect the rotation of the output shaft of the motor 20 according to the movement of the window glass 11; however, there is no need to be limited thereto. The position of the window glass 11 may be directly detected by a well-known technology.

The control device 3 (i.e., the controller 31) of the present embodiment includes a trapping detection section 31*a* and a pinching detection section 31*b*. The controller 31, the motor 20, and the drive circuit 32 receive electric power necessary for actuation from the battery 5 mounted in the vehicle. The controller 31 includes a microcomputer provided with a CPU, an input circuit, an output circuit, and memories such as ROM and RAM. The CPU communicates with the memories, the input circuit, and the output circuit via a bus. In addition, the controller 31 is connected with an ECU 7 in a vehicle body via a wired link (i.e., harness) or wireless link. The controller 31 may be provided as DSP (Digital Signal Processor) or gate array.

In addition, as indicated in FIG. 2, the controller 31 receives, from the ECU 7, various signals such as a remote manipulation signal 7*a*, a smoke emission operating signal 7*b*, an interlocking operating signal 7*c*. The remote manipulation signal 7*a* is a signal received by a reception portion (unshown); the signal includes a signal of the switch 6*a*, 6*b* of the wireless signal switch 6, a switching signal of a door lock, or a switching signal of a trunk. The smoke emission operating signal 7*b* is a signal for discharging or circulating air in the vehicle when an in-vehicle sensing device (unshown) detects anomalous atmosphere in a vehicle space; the sensing device senses heat, smoke, or flame. The interlocking operating signal 7*c* is a signal generated according to manipulation of a vehicle key or door handle, or a signal generated when the vehicle sinks or submerges in water.

Under an usual actuation of the apparatus 1, the controller 31 performs an up-down movement of the window glass 11 by forward and reverse operating the motor 20 via the drive circuit 32 based on a manipulation signal from the switch 4 (down switch 4*a*, up switch 4*b*, auto switch 4*c*). In addition, the controller 31 detects the position of the window glass 11 based on the pulse signal received from the rotation detection unit 27, and adjusts the magnitude of the driving electric power provided to the motor 20 via the drive circuit 32 depending on the detected position of the window glass 11. To be specific, the magnitude of the duty ratio is adjusted when controlling the magnitude of the driving electric power or voltage or controlling PWM (Pulse Width Modulation) in order to adjust the output of the motor 20.

The drive circuit 32 includes an IC having FET (Field Electric Transistor), and switches the polarity of the electric power supply to the motor 20 based on an input signal from the controller 31. That is, when a forward rotation command signal is received from the controller 31, the drive circuit 32 provides electric power to the motor 20 so that the motor 20 rotates in the forward rotation direction. When a reverse rotation command signal is received from the controller 31, the drive circuit 32 provides electric power to the motor 20 so that the motor 20 rotates in the reverse rotation direction. In addition, when a rotation stop command signal is received from the controller 31, the electric power supply to the motor 20 is stopped. The drive circuit 32 may switch the polarity using a relay circuit. In addition, the drive circuit 32 may be incorporated into the controller 31, and thus included in the control device 3.

The controller 31 detects pulse edges that include rising portions and falling portions of pulse signals that are inputted, and calculates a rotation speed (rotational cycle) of the motor 20 based on intervals (cycles) of the pulse edges while detecting the direction of rotation of the motor 20 based on phase differences of the pulse signals. That is, the controller 31 calculates a movement speed of the window glass 11 indirectly based on the rotation speed (rotational cycle) of the motor 20, and specifies the moving direction of the window glass 11 based on the direction of rotation of the motor 20. In addition, the controller 31 counts the pulse edges. The pulse count value is subtracted or added in connection with the open-close movement of the window glass 11. The controller 31 specifies the opening and closing position of the window glass 11 based on the magnitude of the pulse count value.

That is, the window glass 11 can be driven on a basis of the fully closed position defined as a reference position. When the fully closed position is defined as a reference position, the fully closed position corresponds to a pulse count value of zero "0". Thereafter, in cases that the window glass 11 moves toward one end (e.g., fully opened position) of a moving area (movement segment), the pulse count value is incremented each time receiving a pulse signal. In contrast, in cases that the window glass 11 moves toward the other end (e.g., fully closed position) of the moving area, the pulse count value is decremented each time receiving a pulse signal.

Further, the window glass 11 may be moved alternatively on a basis of the fully opened position defined as a reference position. When the fully opened position is defined as a reference position, the fully opened position corresponds to a pulse count value of zero "0". When the window glass 11 moves toward the fully closed position, the pulse count value is incremented. When the window glass 11 moves toward the fully opened position, the pulse count value is decremented.

The switch 4 includes: the down switch 4*a* for opening the window glass 11, the up switch 4*b* for closing the window glass 11, and the auto switch 4*c*, as explained above. The occupant including a driver manipulates the down switch 4*a*, the up switch 4*b*, or the auto switch 4*c*; thereby, the command signal for an open-close movement of the window glass 11 is outputted to the controller 31. The window glass 11 can be moved only during manually (by-hand) manipulating the down switch 4*a* or the up switch 4*b* by occupants, whereas the window glass 11 can be moved to the fully opened position or fully closed position by one-time manipulation of the auto switch 4*c*.

To be specific, the down switch 4*a* is manipulated (pulled or pressed) to one side, the down switch 4*a* is turned on so as to output a usual open command signal to the controller 31; the usual open command signal is for controlling the window glass 11 to perform a usual open movement, which is an open movement executed only during being manipulated, to move to an open state. In contrast, the up switch 4*b* is manipulated (pulled or pressed) to one side, the up switch 4*b* is turned on so as to output a usual close command signal to the controller 31; the usual close command signal is for controlling the window glass 11 to perform a usual close movement, which is a close movement executed only during being manipulated, to move to a close state. The vehicle or the apparatus 1 is provided with a plurality of the switches 4. Several switches 4 are disposed near the driver seat so as to control all the corresponding window glasses 11. Each of the other switches 4 excluding those near the driver seat is disposed near a window glass 11 of an occupant excluding the driver so as to control the nearby window glass 11.

Furthermore, the auto switch 4*c* may be replaced by the down switch 4*a* and the up switch 4*b*, which are swing switches enabled to be manipulated in two steps; this achieves an open function, a close function, and an auto function. To be specific, the down switch 4*a* is manipulated (pulled or pressed) by one step to one side, the down switch 4*a* is turned on so as to output a usual open command signal to the controller 31; the usual open command signal is for controlling the window glass 11 to perform a usual open movement, which is an open movement executed only during being manipulated, to move to an open state. In contrast, the up switch 4*b* is manipulated (pulled or pressed) by one step to one side, the up switch 4*b* is turned on so as to output a usual close command signal to the controller 31; the usual close command signal is for controlling the window glass 11 to perform a usual close movement, which is a close movement executed only during being manipulated, to move to a close state.

Further, the down switch 4*a* is manipulated (pulled or pressed) by two steps to one side, both the down switch and the auto switch are turned on so as to output an auto open command signal to the controller 31; the auto open command signal is for controlling the window glass 11 to perform an auto open movement, which is an open movement to move to a position just prior to the fully open position even after the manipulation is stopped. Further, the up switch 4*b* is manipulated (pulled or pressed) by two steps to one side, both the up switch and the auto switch are turned on so as to output an auto close command signal to the controller 31; the auto close command signal is for controlling the window glass 11 to perform an auto close movement, which is a close movement to move to a position just prior to the fully close position even after the manipulation is stopped.

The present embodiment includes the wireless signal switch 6 other than the switches inside of the vehicle. The wireless signal switch 6, which permits a remote manipulation from an outside of the vehicle, is integrated with a remote key (unshown) using radio waves or infrared rays, for instance. Further, the wireless signal switch 6 may be incorporated into a cell phone. The wireless signal is received as the remote manipulation signal 7*a* of the ECU 7. The wireless signal switch 6 of the present embodiment includes a down switch 6*a* and an up switch 6*b*, switch manipulation of which permits remote manipulation so that the ECU 7 outputs the remote manipulation signal 7*a* to the controller 31. Except for the remote manipulation, the switches 6*a*, 6*b* have the same functions as those of the above-mentioned down switch 4*a* and up switch 4*b*; thus, the explanation of the functions are omitted.

The controller 31 includes the trapping detection section 31*a* and the pinching detection section 31*b*. While receiving the usual open command signal from the down switch 4*a* (while the down switch is being manipulated), the controller 31 drives the motor 20 via the drive circuit 32 to permit a usual open movement of the window glass 11. At this time, when trapping arises, the trapping is detected by the trapping detection section 31*a*. In contrast, while receiving the usual close command signal from the up switch 4*b* (while the up switch is being manipulated), the controller 31 drives the motor 20 via the drive circuit 32 to permit a usual close movement of the window glass 11. At this time, when pinching arises, the pinching is detected by the pinching detection section 31*b*.

In addition, when receiving the auto open command signal or auto close command signal from the auto switch 4*c* (or two step manipulation of the down switch 4*a* or the up switch 4*b*), the controller 31 drives the motor 20 via the drive circuit 32 to permit an auto open movement or auto close movement to move the window glass 11 to a position just prior to the fully open position or a position just prior to the fully close position, respectively.

The controller 31 is monitoring, using the trapping detection section 31*a*, occurrence or non-occurrence of trapping by the window glass 11 when the window glass 11 performs open movement (usual open movement and auto open movement). That is, the occurrence of the trapping causes the decline of the moving speed (descent speed) of the window glass 11 and the decline of the rotation speed of the motor 20 (the extension of the rotational cycle) that relates to the decline of the moving speed of the window glass 11. Therefore, the controller 31 monitors the variation of the rotation speed of the motor 20 continuously.

The trapping detection section 31*a* of the controller 31 detects the start of the trapping between the window glass 11 and the belt moldings 13, 14 based on the variation of the rotation speed of the motor 20 (that is, the descent speed of the window glass 11), and then determines the occurrence of the trapping (i.e., determines affirmatively the trapping) when detecting that the rotation speed varies by a predetermined quantity after detecting the start of the trapping.

When the trapping is determined affirmatively (i.e., the occurrence of trapping is determined), the controller 31 intends to release a foreign matter trapped between the window glass 11 and the belt moldings 13, 14 or stop the progress of the trapping. To that end, the controller 31 controls the electric power supply to the motor 20 to stop or reverse the movement of the motor 20, thereby stopping the open movement (descent) of the window glass 11 or raising or heightening (i.e., providing a close movement to) the window glass 11 by a predetermined distance (predetermined quantity).

In contrast, the controller 31 is monitoring, using the pinching detection section 31*b*, occurrence or non-occurrence of pinching by the window glass 11 when the window glass 11 performs close movement (usual close movement and auto close movement). The detection of the pinching can use a well-known technology that above-mentioned Patent Literatures; thus, the explanation of the detail is omitted. In addition, in the above, the occurrence or non-occurrence of the trapping is monitored based on the variation of the rotation speed of the motor 20 relevant to the moving speed or moving state of the window glass 11. There is no need to be limited thereto. For instance, the moving state of the window glass 11 can be detected by monitoring the variation of the electric current which flows into the motor 20 that is being driven. When the electric current rises more than a predetermined value, the trapping may be detected.

Figure 4A:
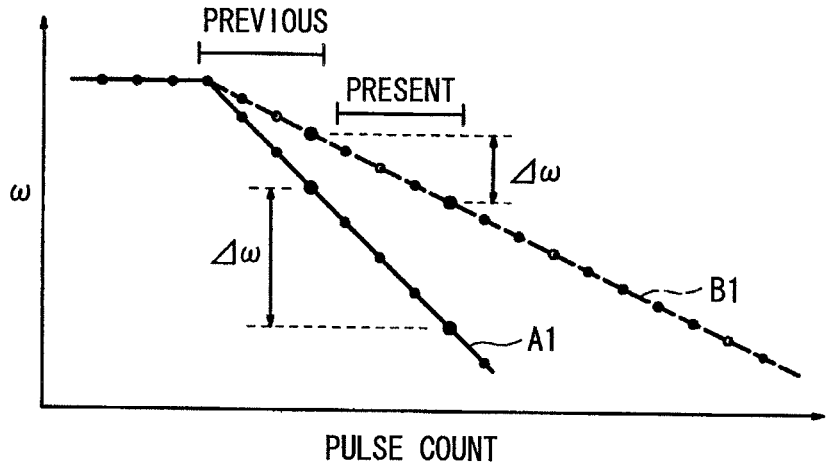
FIGS. 4A, 4B, 4C are diagrams for explaining trapping determination.
Figure 4B:
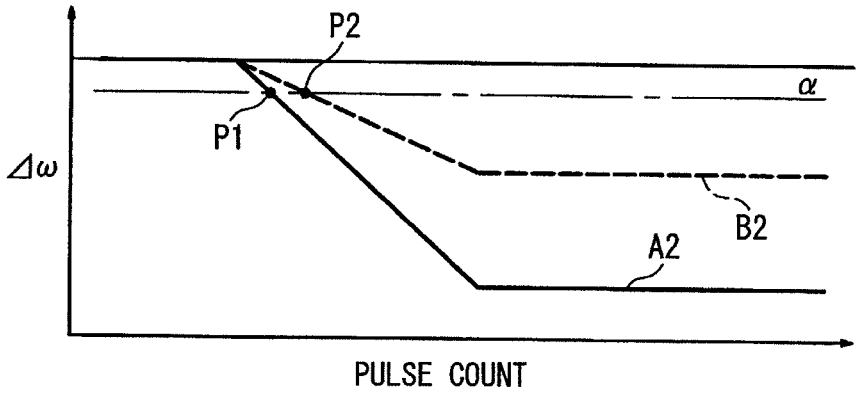
Figure 4C:
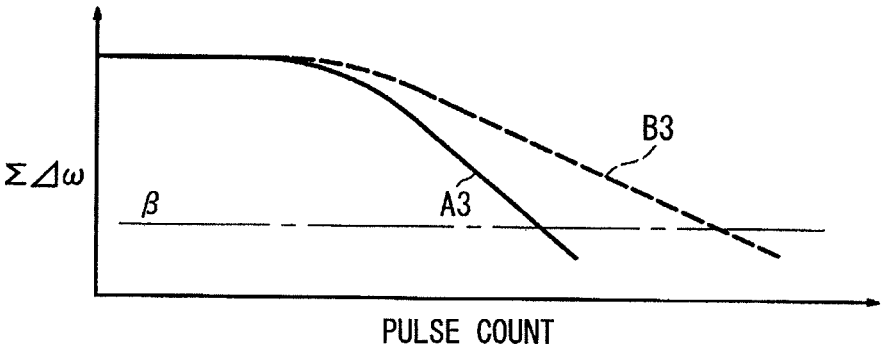

The following will explain an outline of a process to determine trapping in the apparatus 1 with reference to FIG. 4. The trapping detection section 31*a* of the controller 31 calculates a rotation speed ω of the motor 20 based on pulse signals received from the rotation detection unit 27, and stores the calculated rotation speed ω of the motor 20. FIG. 4A illustrates a variation state of the rotation speed ω calculated in the above. The axis of ordinates of FIG. 4A corresponds to a motor rotation speed, and the axis of abscissa corresponds to a pulse count. FIG. 4A indicates an example of a state where the trapping decreases the rotation speed ω of the motor 20 from a middle time point. The data line A1 indicates a state where a hard matter is trapped to decrease the rotation speed ω with a large deceleration; The data line B1 indicates a state where a soft matter is trapped to decrease the rotation speed ω with a small deceleration. Further, in FIG. 4B and FIG. 4C, the data lines A2 and A3 correspond to the state where a hard matter is trapped; the data lines B2, B3 correspond to a soft matter is trapped.

The apparatus 1 of the present embodiment performs moving speed variation computation using an illustrated CPU. A rotation speed difference Δω is calculated based on the data of the rotation speed ω; the rotation speed difference Δω is a difference between the rotation speed ω at the present time and the rotation speed ω at a previous time before the present time by several pulse edges. That is, the variation of the rotation speed ω at the present time against the rotation speed ω at the previous time is calculated. The rotation speed difference Δω is equivalent to the rate of change in the rotation speed (moving speed) or equivalent to the variation or the changed portion of the rotation speed from before the present time by the several pulse edges. FIG. 4B indicates the variation state of the rotation speed difference Δω. In FIG. 4A, the absolute value of the rotation speed difference Δω of the data line A1 is greater than that of the data line B1.

Now, the trapping detection section 31*a* of the controller 31, which detects the start of trapping, determines whether the calculated rotation speed difference Δω exceeds a variation determination threshold α. When the variation determination threshold α is exceeded, it is determined that the trapping has started. In FIG. 4B, the start of trapping is detected at the point P1 or the point P2. However, the trapping is not determined at this time, so the motor 20 continues rotating and the window glass 11 continues descent (open movement). The variation determination threshold α is designated in the apparatus 1 such that even a soft matter (for example, a lip portion of the belt molding) is trapped to cause the resultant rotation speed difference Δω to exceed the variation determination threshold value a.

Thus, at a time when the start of trapping is detected by the trapping detection section 31*a*, the controller 31, which is to determine trapping in the apparatus 1, determines whether the accumulated value of the rotation speed difference Δω from the time (that is, the variation value of the rotation speed ω) exceeds a trapping determination threshold β. When the variation value of the rotation speed ω exceeds the trapping determination threshold β, the trapping is determined affirmatively. FIG. 4C indicates a variation state of the accumulated value of the rotation speed difference Δω. The controller 31 determines the trapping affirmatively when the accumulated value exceeds the trapping determination threshold β.

As explained above, the trapping is determined affirmatively when the accumulated value of the rotation speed difference Δω (i.e., the variation value of the rotation speed ω) after the trapping detection section 31*a* detects the start of trapping exceeds the trapping determination threshold β. Alternatively, the trapping may be determined affirmatively when the accumulated value of the rotation speed difference Δω for a predetermined period after detecting the start of trapping, or the accumulated value of the rotation speed difference Δω for a predetermined count (i.e., the rate of change in the rotation speed ω) exceeds the trapping determination threshold β.

Thus, the apparatus 1 sets two thresholds. One variation determination threshold α is set to the rotation speed difference Δω; the other trapping determination threshold β is set to the variation value of the rotation speed ω (the total of the rotation speed difference Δω). These differ in a determination target. In the apparatus 1 of the present embodiment, the actual occurrence of the trapping is not determined by a duration or the number of pulse signals after the rotation speed difference Δω exceeds the variation determination threshold α. Trapping is determined based on the variation amount of the rotation speed ω after the rotation speed difference Δω exceeds the variation determination threshold α.

Therefore, in the apparatus 1 of the present embodiment, when a foreign matter is trapped, the trapping load does not become much greater. Trapping of a foreign matter may be determined affirmatively while not providing damage to the trapped foreign matter. In the apparatus 1 of the present embodiment, even when a soft matter is trapped, the rotation speed difference Δω exceeds the variation determination threshold α at a comparatively earlier stage. When the variation amount thereafter exceeds the trapping determination threshold β, the trapping is determined affirmatively. In this case, the trapped matter is a soft matter such as a lip portion of the belt molding; therefore, the rotation speed difference Δω does not become a small value (large as an absolute value). The accumulation of the rotation speed difference Δω starts once the variation determination threshold α is exceeded; thereby, when the accumulated value exceeds the trapping determination threshold β, the trapping can be certainly determined affirmatively.

In addition, when a matter having a middle hardness is trapped, the rotation speed difference Δω exceeds the variation determination threshold α at an earlier stage like the case with a soft matter; then, the accumulation of the rotation speed difference Δω is started. When the accumulated value exceeds the trapping determination threshold β, the trapping can be thus determined certainly. Thus, the apparatus 1 of the present embodiment can determine the trapping certainly under a small load, regardless of whether the trapped matter is soft or hard.

In addition, when the window glass 11 moves, the rotation speed of the motor 20 is influenced by sliding resistance or external factor even without occurrence of the trapping. Such influence may cause the rotation speed difference Δω to exceed the variation determination threshold α. Even in such a case, as long as the accumulated value of the rotation speed difference Δω does not exceed the trapping determination threshold β, the trapping is not determined (i.e., the trapping is determined negatively). Even when the variation determination threshold α is set to a value for a soft matter being trapped, an erroneous determination is not made, and, rather, the start of trapping can be detected certainly.

Figure 6:
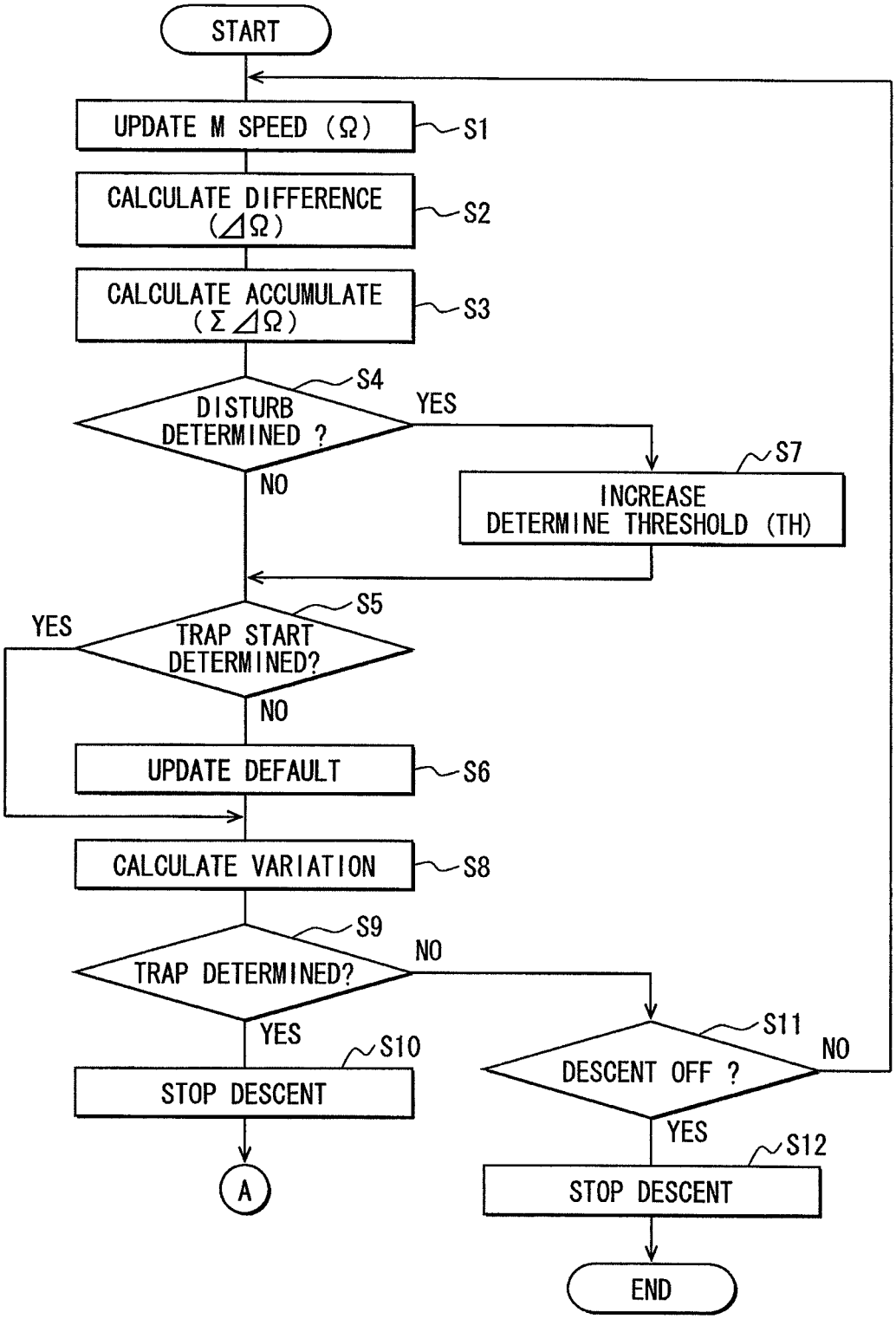
FIG. 6 is a flowchart diagram illustrating a trapping determination process according to a first embodiment of the present disclosure.

The following will explain a flowchart of a process to determine trapping by the controller 31 with reference to FIG. 6. The trapping detection portion 31*a* of the controller 31 of the present embodiment updates a rotation speed data of the motor 20 first based on the pulse signals received from the rotation detection unit 27 (S1). To be specific, the trapping detection section 31*a* of the controller 31 processes a pulse signal received from the rotation detection unit 27, and detects a pulse edge. Each time detecting the pulse edge, a pulse width (time interval) T between the pulse edge detected at the previous time and the pulse edge detected at the present time is calculated, and is stored one by one in a memory.

In the present embodiment, each time a new pulse edge is detected, the pulse width T is updated in order, and the newest four pulse widths T(0)-T(3) are stored. That is, when a pulse edge is detected, a new pulse width T(0) is calculated; the previous pulse widths T(0)-T(2) are shifted by one to be referred to as the pulse widths T(1)-T(3), respectively, and the previous pulse width T(3) is erased.

Then, the controller 31 calculates a rotation speed ω from the inverse number of the total (pulse cycle P) of the pulse widths T of n pulse edges serial in time. The rotation speed ω is a value proportional to the actual rotation speed. In the present embodiment, the (average) rotation speed ω(0) is calculated by the pulse widths T(0)-T(3) obtained from the present pulse edge and four previous pulse edges. Then, when the following pulse edge is detected, the rotation speed ω(0) is updated or replaced by the newly calculated pulse widths T(0)-T(3). At this time, the previous rotation speed ω(0) is stored as a rotation speed ω(1). Thus, the newest eight rotation speeds ω(0) to ω(7), which are updated each time a pulse edge is detected (with respect to each predetermined movement amount or each predetermined rotation angle), are always stored in the controller 31. Thus, calculating the rotation speed ω using more than one pulse width T permits offsetting of dispersion in a sensor duty of each received pulse signal output, and calculation of the rotation speed whose error variation is offset.

Next, the controller 31 calculates a (average) rotation speed difference Δω (i.e., rate of change of the rotation speed) from the rotation speed ω (S2). To be specific, the rotation speeds ω(0)-ω(3) are referred to as the present block data; the rotation speeds ω(4)-ω(7) are referred to as the previous block data. The sum of one block data is subtracted from the sum of the other block data. That is, the rotation speed difference Δω is calculated by subtracting the sum of the rotation speeds ω(0)-ω(3) from the sum of the rotation speeds ω(4)-ω(7), and updated each time a pulse edge is detected (every predetermined movement amount or every predetermined rotation angle). The sum of the calculated values may be divided by the number of data for obtaining the sum (four in the present embodiment). Thus, calculating the rotation speed difference Δω using more than one rotation speed ω can offset the phase difference between the rotation speeds ω.

Then, the controller 31 adds up the calculated rotation speed difference Δω on a basis of a predetermined position of the window glass 11 serving as a reference position (S3). Each time the rotation speed difference Δω is calculated, it is accumulated; thereby, the difference of the rotation speed ω is calculated on a basis of the reference position. Next, it is determined whether the calculated rotation speed difference Δω transcends a disturbance determination threshold γ to the positive side (S4). When the vehicle runs over a bump or level difference or when the window glass 11 is shut, such disturbance may apply or add an impact to the window glass 11, influencing the rotation speed of the motor 20. The present embodiment provides a process to prevent mis-detection of trapping due to such disturbance.

Figure 5:
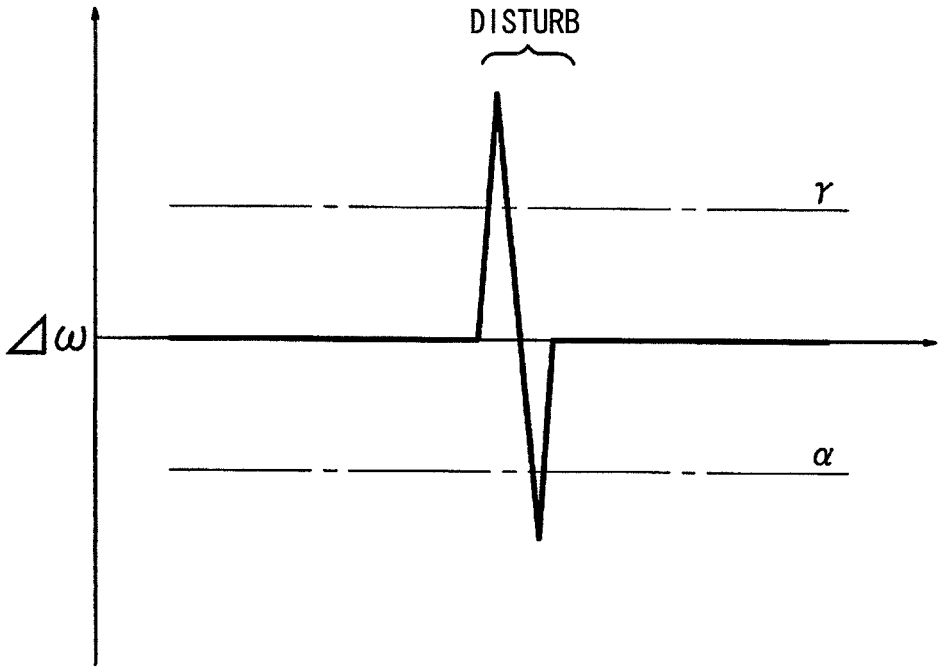
FIG. 5 is a diagram for explaining a rotation speed difference when disturbance arises.

As indicated in FIG. 5, when disturbance arises, the rotation speed difference Δω usually takes large values in the positive side and the negative side. That the rotation speed difference Δω sways to the positive side signifies that the rotation of the motor 20 is accelerated to open the window glass 11. By contrary, that the rotation speed difference Δω sways to the negative side signifies that the rotation of the motor 20 is decelerated; that the rotation speed difference Δω sways to the negative side simulates trapping. It is noted that the disturbance determination threshold γ is a value set to the positive side; the controller 31 determines an occurrence of disturbance when the rotation speed difference Δω exceeds the disturbance determination threshold γ to the positive side.

When it is determined that the disturbance occurred (S4: Yes), the controller 31 increases the trapping determination threshold β to the negative side (S7), then advancing to S5. For instance, thereafter, disturbance may cause the rotation speed difference Δω to sway to the negative side so that the start of trapping may be detected. Even in such a case, the accumulated value of the rotation speed difference Δω does not exceed the trapping determination threshold β that was increased; this helps prevent an erroneous determination of trapping. In the present embodiment, the disturbance determination threshold γ is set to be irrelevant to the variation determination threshold α. For example, the disturbance determination threshold γ may be set to a value obtained by switching reversely between positive and negative of the variation determination threshold α.

When it is determined that any disturbance did not occur (S4: No), the controller 31 performs a determination process of a trapping start (S5). To be specific, when the rotation speed difference Δω exceeds the variation determination threshold α to the negative side, the start of trapping is determined. When not exceeding, the start of trapping is not determined. When the start of trapping is determined (S5: Yes), the controller 31 advances to S8. When the start of trapping is not determined (S5: No), a default value is set to each of the accumulated value of the rotation speed difference Δω and the trapping determination threshold β (S6). To be specific, the accumulated value of the rotation speed difference Δω calculated at S3 is set to a default variation amount So of the rotation speed ω, whereas the trapping determination threshold R is returned to the usual value that is not increased. Thus, when it is determined that a period of the disturbance ends, the trapping determination threshold β is returned to the normal value; this re-starts a usual process.

Then, the variation amount S of the rotation speed ω is calculated (S8). To be specific, the controller 31 subtracts the accumulated value of the rotation speed difference Δω calculated at S3 from the default variation amount So of the rotation speed ω set at S6 just before determining the start of trapping, thereby calculating the variation amount S of the rotation speed ω (accumulated value of the rotation speed difference Δω) after the start of trapping. This permits certainly the calculation of the variation portion of the rotation speed (i.e., trapping load) due to trapping.

In the present embodiment, the variation amount of the rotation speed ω after the start of trapping is calculated by calculating the difference of the variation amount from the reference value. There is no need to be limited thereto. When the start of trapping is not detected, the accumulated value of the rotation speed difference Δω may be initialized; when the start of trapping is detected, the accumulated value of the rotation speed difference Δω may not be initialized. This also permits accumulation of the rotation speed difference Δω only after the start of trapping, thereby calculating the variation amount of the rotation speed ω.

Next, the controller 31 determines whether the variation amount S of the rotation speed ω calculated at S8 exceeds the trapping determination threshold β (S9). When it is determined that the variation amount S of the rotation speed ω exceeds the trapping determination threshold β (S9: Yes), the controller 31 performs a descent movement stop process (S10).

In contrast, when it is not determined that the variation amount S of the rotation speed ω exceeds the trapping determination threshold β (S9: No), it is determined whether a signal of an OFF of the down switch 4*a* is received (S11). When not receiving the signal of the OFF (S11: NO), the controller 31 returns to S1. When receiving the signal of the OFF (S11: YES), the descent movement stop process is executed (S12) and the present process ends. The descent movement stop of the window glass 11 is executed by the controller 31, which controls the supply of the electric power to the motor 20 to stop the movement of the motor 20 to thereby stop the open movement (descent) of the window glass 11.

Figure 7:
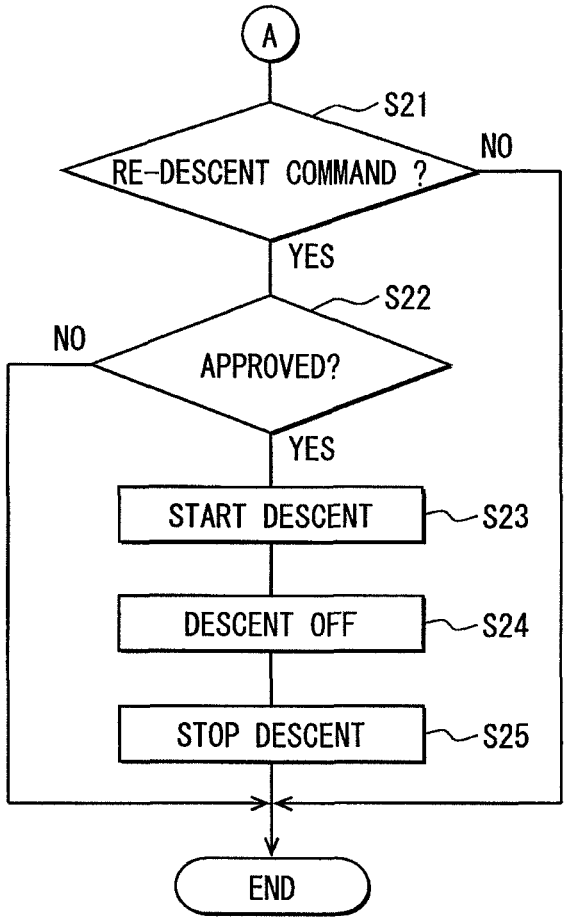
FIG. 7 is a flowchart diagram illustrating a full open mode according to the first embodiment.

After the window glass 11 stops by the descent movement stop at S10, the controller 31 advances to S21 in FIG. 7, where the occurrence or non-occurrence of a re-descent movement command is determined. When the re-descent movement command occurs (S21: Yes), a re-descent movement approval determination is executed (S22). When the re-descent movement approval determination determines that a re-descent is approved (S22: Yes), the window glass 11 starts the descent movement (S23). The descent of the window glass 11 is performed until a signal of an OFF of the down switch 4*a* is received. Upon receiving the signal of the OFF of the down switch 4*a* (S24), the descent movement is stopped to stop the open-close member (S25).

When the re-descent movement command does not occur (S21: No), the present process ends with the window glass 11 remaining in the descent movement stop (S10). As explained above, when the trapping determination is performed to thereby determine the trapping at S9, the descent movement of the window glass 11 stops at S10. When the re-descent movement command thereafter occurs at S21, the re-descent approval determination is executed at S22. When the re-descent is approved, the re-descent movement of the window glass 11 is started at S23 and continues until the down switch 4*a* is turned into an OFF at S24. Thus, even after the trapping is determined, when the re-descent movement is approved based on a predetermined condition, the controller 31 controls the electric power supply to the driving device 2, thereby driving the open-close member so as to permit re-start of the open movement.

Figure 8:
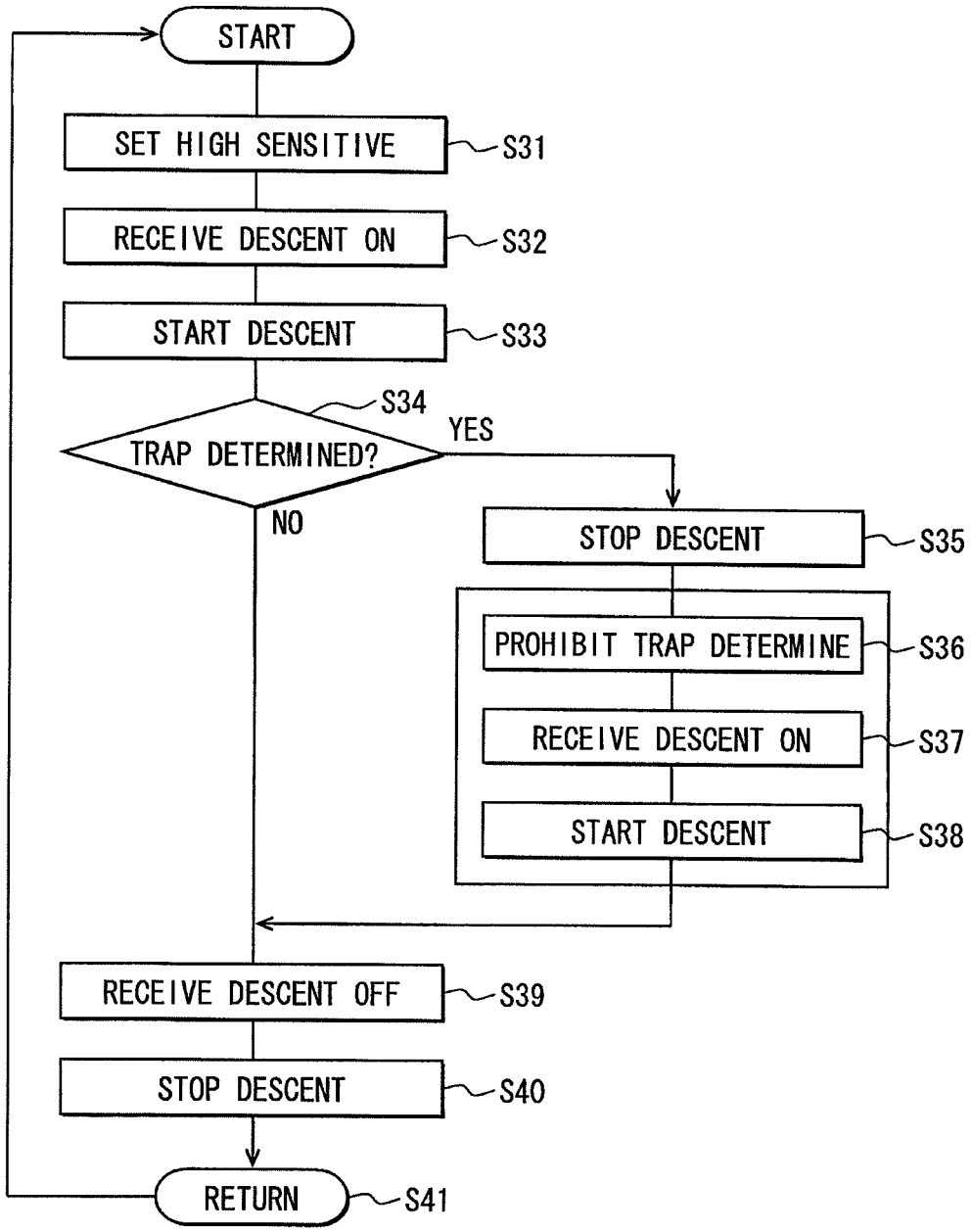
FIG. 8 is a flowchart diagram illustrating a process after trapping detection according to the first embodiment.

FIG. 8 is a flowchart including a full open mode after detecting trapping. In this example of FIG. 8, the controller 31 performs a setting process of a high sensitivity threshold (S31). The high sensitivity threshold is set to be equivalent to the above mentioned variation determination threshold α and trapping determination threshold β.

After the setting process of high sensitivity threshold (S31), an ON of the down switch 4*a* is inputted, thereby a down switch signal is inputted to the controller 31 (S32). When the down switch signal is inputted at S32, the window glass 11 starts a descent movement (S33). The controller 31 performs a trapping determination during the descent movement (S34). The trapping determination at S34 performs S1 to S9 in FIG. 6.

When the trapping is not determined (S34: No), the window glass 11 descends until the down switch 4*a* is turned into OFF. Upon receiving a signal of an OFF of the down switch 4*a* following the down switch 4*a* being turned into OFF, the controller 31 executes the descent movement stop process (i.e., to stop the descent movement) (S40), stopping the electric power supply to the motor 20 to stop the descent movement of the window glass 11.

The following will explain a full open mode, which corresponds to S36 to S38, which take place after stopping the descent movement at S35. Now, a trapping determination prohibition process is executed (S36). In the trapping determination prohibition process, the controller 31 receives a down switch signal (S37); thereby, the window glass 11 starts the descent movement (S38). Therefore, the window glass 11, which has been under the stopped state, re-starts descent movement following the manipulation to the down switch 4*a*, which is a premise for S37. Thus, under the state where the down switch 4*a* is not manipulated, the window glass 11 continues the stopped state.

Thus, the trapping determination prohibition process in the full open mode is executed (S36). A switch manipulation is made for the open movement within a predetermined period (for example, less than 5 seconds) since the trapping is detected and the window glass 11 is stopped, thereby inputting a signal to the controller 31 as a down switch signal input (S37). The descent movement of the window glass 11 starts (S38) while the trapping determination is prohibited. An OFF manipulation is made to the down switch 4*a*; the down switch signal OFF is detected (S39). The controller 31 controls the supply of the electric power to the motor 20 to stop the actuation or movement of the motor 20 to stop the open movement (descent) of the window glass 11.

In general, the down switch 4*a* is usually provided near each corresponding window glass 11 out of a plurality of the window glasses 11; in addition, manipulation switches for all the open-close members (i.e., all the window glasses 11) are provided at the driver seat. The down switch 4*a* of the present embodiment is provided as a down switch 4*a*, which is disposed near a corresponding open-close member and manually manipulated to thereby permit an open movement as a full open mode. For example, while the down switch 4*a* continues being manipulated, the open movement is continued while the trapping determination prohibition process serving as the full open mode continues. This permits certain open movement of only an open-close member that is desired to be opened. Only an occupant near the corresponding open-close member can execute open movement while manipulating the down switch 4*a*; in addition, only such an occupant near the corresponding open-close member can determine whether to re-start open movement. Safety check can be thus enhanced.

In the present embodiment, the predetermined condition for the full open mode in the re-descent approval determination may include the following four conditions (a to d).

a. The ignition key serving as an engine key of the vehicle is in an ON state.

b. The trapping detection takes place while a window glass 11 near a seat of an occupant is under descent movement.

c. An elapsed time is within a predetermined period (for example, less than 3 to 8 seconds, preferably less than 5 seconds) since the window glass 11 stops after the trapping detection.

d. A manual manipulation is made by an occupant, within the above-mentioned predetermined period, to the down switch 4*a* for opening the window glass 11 near a seat of the occupant.

Figure 9:
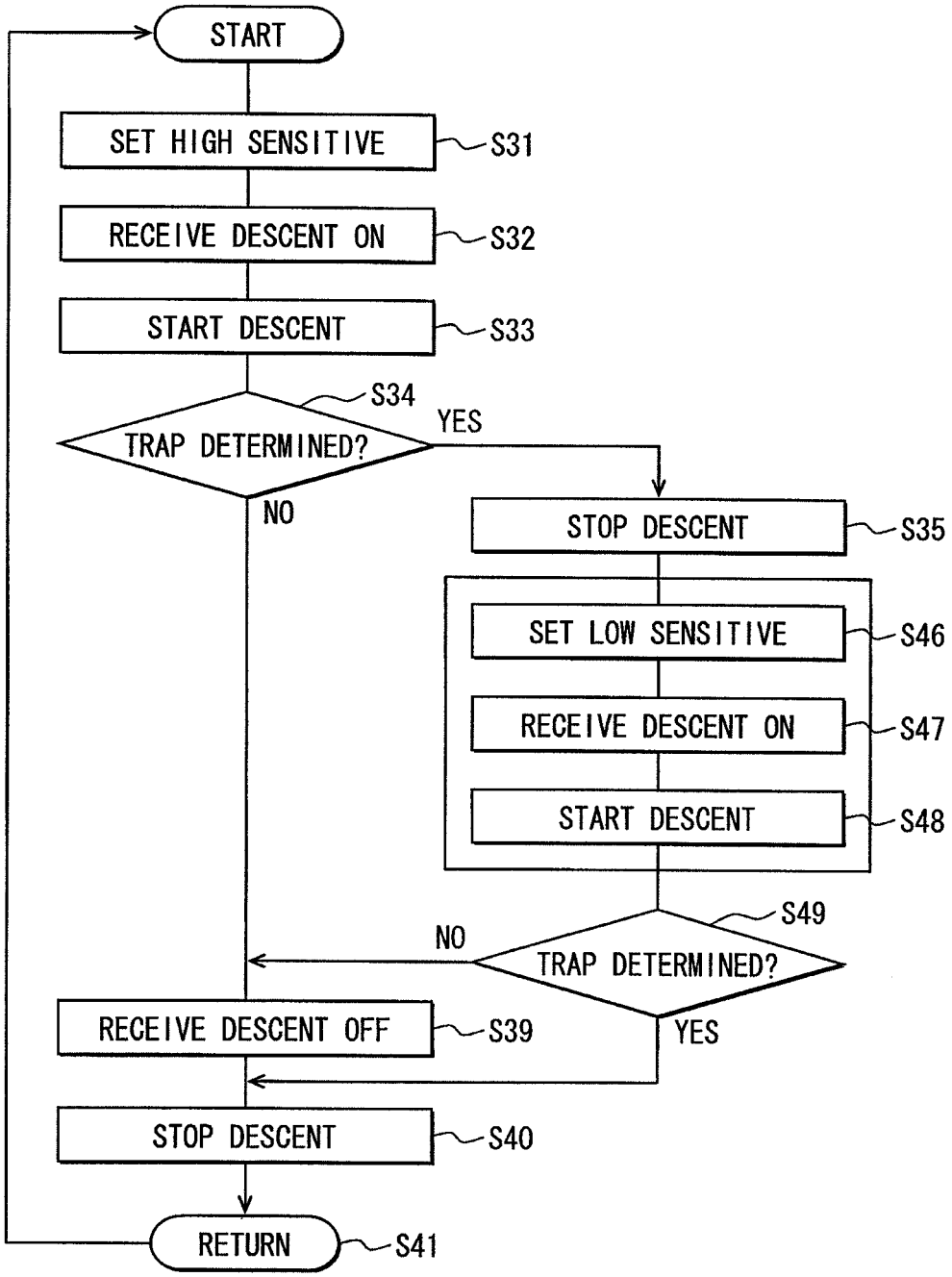
FIG. 9 is a flowchart diagram illustrating another process after trapping detection according to the first embodiment.

FIG. 9 is a flowchart including another full open mode after detecting trapping. In FIG. 8, the trapping determination prohibition process is executed as a full open mode. In FIG. 9, a low sensitivity threshold setting process is made so as to execute the subsequent trapping determination again using the low sensitivity threshold that is less sensitive than the high sensitivity threshold of the first trapping determination.

S31 to S35, and S39 to S41 in FIG. 9 are the same as those in FIG. 8. Thus, the explanation therefor is omitted. The following will explain S46 to S49 that are not contained in FIG. 8. Under the state where the descent movement of the window glass 11 is stopped (S35), a low sensitivity threshold setting process is executed (S46). In the present process, the setting process is to set the variation determination threshold $\alpha$ and the trapping determination threshold $\beta$ to become large and provide an insensitive state. It is noted that each of the variation determination threshold $\alpha$ and the trapping determination threshold $\beta$ may be collectively referred to as a trapping detection condition (i.e., trapping detection threshold) or an open-stop condition (i.e., open-stop threshold) that is used in association with trapping detection for determining whether to stop open movement of the open-close member.

After the setting process of the low sensitivity threshold (S46), an ON of the down switch 4*a* is inputted, thereby a down switch signal is inputted to the controller 31 (S47). When the down switch signal is inputted at S47, the window glass 11 re-starts descend movement (S48). The controller 31 performs a trapping determination during the descent movement (S49). S49 is the same as S34, which performs the trapping determination at S1 to S9 in FIG. 6.

As explained above, the full open mode is provided to make the detection threshold insensitive. The window glass 11 can be opened (descent movement is executed) without degrading manipulability even when a foreign matter such as a belt molding is trapped or jammed.

Thus, after detecting trapping once, the trapping detection may be cancelled or the detection threshold (open-stop condition or open-stop threshold) of the trapping detection may be changed into an insensitive state. This permits the open movement securely even when trapping is incorrectly detected, thereby preventing decline in manipulability. Trapping may be incorrectly detected during the open movement; this results in stopping of the open-close member. Even in such a case, the open movement can be re-started to permit the open-close member to open continuously to reach a desired position.

Aspects of the first embodiment of the present disclosure described herein are set out in the following clauses.

As a first aspect of the first embodiment, an open-close member control apparatus is provided to prevent a foreign matter from being trapped to an open-close member that is driven to open based on manipulation of a manipulation switch. The apparatus includes: a driving device which drives open movement or close movement of the open-close member; a control device which controls actuation of the driving device; a movement detection device which outputs a movement state signal according to a movement state of the open-close member that is driven to open or close by the driving device; and a trapping detection section which performs trapping detection to detect trapping of the foreign matter to the open-close member based on the movement state signal. The trapping detection section further determines affirmatively or negatively the trapping of the foreign matter to the open-close member (i.e., determines occurrence or non-occurrence of the trapping of the foreign matter to the open-close member) based on a result of comparing the movement state signal outputted by the movement detection device with a trapping determination threshold. The control device stops an electric power supply to the driving device when the trapping detection section determines affirmatively the trapping of the foreign matter, permitting stop of open movement of the open-close member. The control device starts, under a predetermined re-open condition, an electric power supply to the driving device based on manipulation of the manipulation switch in a condition-alleviated state, permitting re-start of open movement of the open-close member. The condition-alleviated state uses a second trapping detection condition, which is alleviated from a first trapping detection condition used before and when the trapping detection determines affirmatively the trapping.

For instance, the second trapping detection condition of the condition-alleviated state is less sensitive than the first trapping detection condition. Being less sensitive is equivalent to having lower sensitivity. For instance, the condition-alleviated state uses as the second trapping detection condition, another trapping determination threshold, which is less sensitive than the trapping determination threshold used before and when the trapping detection determines affirmatively the trapping. For instance, alternatively, the condition-alleviated state uses a second open-stop condition, which is alleviated from a first open-stop condition used before and when the open-close member is caused to stop open movement due to the trapping of the foreign matter.

As a second aspect being optional to the first aspect, the condition-alleviated state may be a non-detection state that is a state that cancels the trapping detection.

As a third aspect being optional to the first aspect, the second trapping detection condition of the condition-alleviated state may have a second detection threshold that is more difficult to exceed, in the trapping detection, than a first detection threshold of the first trapping detection condition.

As a fourth aspect being optional to the first aspect, the predetermined re-open condition may be continued manual manipulation of the manipulation switch to send a signal requiring open movement of the open-close member to the control device.

As a fifth aspect being optional to the first aspect, the predetermined re-open condition may be manipulation of the manipulation switch for open movement of the open-close member, the manipulation being made within a predetermined period since the open-close member is stopped after the trapping detection. This configuration permits a manipulator or occupant to promptly execute the open movement of the open-close member certainly.

As a sixth aspect being optional to the first aspect, a plurality of the open-close members may be provided and a plurality of the manipulation switches may be provided; one manipulation switch may be disposed near one open-close member for manipulating the one open-close member; and the predetermined re-open condition for the one open-close member may be manipulation of the one manipulation switch disposed near the one open-close member, the manipulation being for open movement of the one open-close member.

This configuration permits certain execution of open movement of only the open-close member which is required to open. For instance, the driver can usually operate a window glass as an open-close member near a backseat which is distant from the driver seat. Resumption of the open movement of a window glass is only allowed by a switch near the window glass, but is not allowed by a switch distant from the window glass. This permits only a user or manipulator adjacent to the window glass to determine whether to execute switch manipulation to permit open movement, thereby enhancing safety check.

As another aspect of the first embodiment, an open-close member control apparatus is provided to include the same elements of the driving device, the control device, the movement detection device, and the trapping detection section of those of the above apparatus according to the first aspect. In this apparatus according to this aspect, the trapping detection section calculates a variation amount of opening speed of the open-close member based on the movement state signal, and determines affirmatively or negatively the trapping of the foreign matter to the open-close member (i.e., occurrence or non-occurrence of the trapping of the foreign matter to the open-close member) as a result of comparing a predetermined calculation result based on the calculated variation amount of opening speed with a trapping determination threshold. The control device stops an electric power supply to the driving device when the trapping detection section determines affirmatively the trapping of the foreign matter. Further, the control device controls the electric power supply to the driving device when the re-open approval determination is affirmatively made based on a predetermined condition after the trapping is affirmatively determined. The open-close member, which was stopped due to the stopping of the electric power supply to the driving device, is enabled to re-start open movement due to the re-start of the electric power supply to the driving device when the predetermined condition in the re-open approval determination is satisfied.

Under the above configuration, even when a sliding loss in the open-close member becomes great, when the predetermined condition in re-open approval determination is satisfied, the open-close member is driven by the electric power supply to the driving device and the resumption of the open movement is enabled. The open movement of the open-close member can be thus carried out certainly.

Second Embodiment

A second embodiment of the present disclosure will be explained. The configuration in the first embodiment explained using FIGS. 1 to 4 is also applied to the second embodiment; thus, the explanation thereof is omitted. Other features of the second embodiment will be explained with reference to FIGS. 10 to 13. The following will explain a flowchart of an open movement of an open-close member as a window glass 11 and a process to determine trapping by the controller 31 with reference to FIG. 10. When a descent command by the down switch 4*a* of the switch 4 or down switch 6*a* of the wireless signal switch 6 is issued (S101), it is determined whether the trapping detection cancellation condition is satisfied (S102) before actuating or using the trapping detection section 31*a*. The detection cancellation condition, which is predetermined, is based on the following signal or state: a down switch ON signal in the remote manipulation signal 7*a*; a smoke emission operating signal 7*b*; a signal indicating vehicle submerging in water in the interlocking operating signal 7*c*; a manipulation state in the switch 4, wireless signal switch 6, or auto switch 4*c*; a signal indicating descent movement at re-start after trapping detection; or a manipulation signal made within a predetermined period after trapping detection.

When the trapping detection cancellation condition is satisfied (S102: Yes), a cancellation process is executed to cancel the trapping detection section (S103). With the cancellation process to cancel or disable the trapping detection section at S103, the open movement of the window glass 11 is started without executing a trapping determination (S104), and the window glass 11 descends until the switch state becomes the down switch OFF (S105). The down switch OFF is a stop signal by the down switch or a stop signal when the window glass 11 reaches the full open position; the stop signal is inputted to the controller 31. Then, the controller 31 stops the electric power supply to the motor 20; the motor 20 is thus stopped. When the switch state becomes the down switch OFF, the descent movement of the window glass 11 stops (S106).

In contrast, when the trapping detection cancellation condition is not satisfied (S102: No), the descent movement or open movement of the window glass 11 starts (S107). After the descent movement is started at S107, the process of the trapping detection section 31*a* of the controller 31 is executed.

The trapping detection section 31*a* of the controller 31 updates a rotation speed data of the motor 20 first based on the pulse signals received from the rotation detection unit 27 (S108). To be specific, the trapping detection section 31*a* of the controller 31 performs signal processing of the pulse signals received from the rotation detection unit 27, and detects pulse edges. Each time detecting the pulse edge, a pulse width (time interval) T between the pulse edge detected at the previous time and the pulse edge detected at the present time is calculated, and is stored one by one in a memory.

In the present embodiment, each time a new pulse edge is detected, the pulse width T is updated in order, and the newest four pulse widths T(0)-T(3) are stored. That is, when a pulse edge is detected, a new pulse width T(0) is calculated; the previous pulse widths T(0)-T(2) are shifted by one to be referred to as the pulse widths T(1)-T(3), respectively, and the previous pulse width T(3) is erased.

Then, the controller 31 calculates a rotation speed ω from the inverse number of the total (pulse cycle P) of the pulse widths T of n pulse edges serial in time. The rotation speed ω is a value proportional to the actual rotation speed. In the present embodiment, the (average) rotation speed ω(0) is calculated by the pulse widths T(0)-T(3) obtained from the present pulse edge and four previous pulse edges. Then, when the following pulse edge is detected, the rotation speed ω(0) is updated or replaced by the newly calculated pulse widths T(0)-T(3). At this time, the previous rotation speed ω(0) is stored as a rotation speed ω(1). Thus, the newest eight rotation speeds ω(0) to ω(7), which are updated each time a pulse edge is detected (with respect to each predetermined movement amount or each predetermined rotation angle), are always stored in the controller 31. Thus, calculating the rotation speed ω using more than one pulse width T permits (i) offsetting of dispersion in a sensor duty of each received pulse signal output, and (ii) calculation of the rotation speed whose error variation is offset.

Next, the controller 31 calculates a (average) rotation speed difference Δω (i.e., rate of change of the rotation speed) from the rotation speed ω (S109). To be specific, at S109, the rotation speeds ω(0)-ω(3) are referred to as the present block data; the rotation speeds ω(4)-ω(7) are referred to as the previous block data. The sum of one block data is subtracted from the sum of the other block data. That is, the rotation speed difference Δω is calculated by subtracting the sum of the rotation speeds ω(0)-ω(3) from the sum of the rotation speeds ω(4)-ω(7), and updated each time a pulse edge is detected (every predetermined movement amount or every predetermined rotation angle). The sum of the calculated values may be divided by the number of data for obtaining the sum (four in the present embodiment). Thus, calculating the rotation speed difference Δω using more than one rotation speed ω can offset the phase difference between the rotation speeds ω.

Then, the controller 31 adds the calculated rotation speed difference Δω on a basis of a predetermined position of the window glass 11 serving as a reference position (S110). Each time the rotation speed difference Δω is calculated, it is accumulated; thereby, the difference of the rotation speed ω with respect to the reference position is calculated. Next, it is determined whether the calculated rotation speed difference Δω transcends a disturbance determination threshold γ to the positive side (S111). When the vehicle runs over a bump or level difference or when the window glass 11 is shut, such disturbance may apply or add an impact to the window glass 11, influencing the rotation speed of the motor 20. The present embodiment provides a process to prevent mis-detection of trapping due to such disturbance.

As indicated in FIG. 5, when disturbance arises, the rotation speed difference Δω usually takes large values in the positive side and the negative side. That the rotation speed difference Δω sways to the positive side signifies that the rotation of the motor 20 is accelerated to open the window glass 11. By contrast, that the rotation speed difference Δω sways to the negative side signifies that the rotation of the motor 20 is decelerated, and simulates trapping. It is noted that the disturbance determination threshold γ is a value set to the positive side; the controller 31 determines the occurrence of disturbance when the rotation speed difference Δω exceeds the disturbance determination threshold γ to the positive side.

When it is determined that the disturbance occurred (S111: Yes), the controller 31 increases the trapping determination threshold β to the negative side (S112), then advancing to S113. For instance, thereafter, disturbance may cause the rotation speed difference Δω to sway to the negative side so that the start of trapping is detected. Even in such a case, the accumulated value of the rotation speed difference Δω does not exceed the trapping determination threshold β that was increased; this helps prevent an erroneous detection of trapping. In the present embodiment, the disturbance determination threshold γ is set to be irrelevant to the variation determination threshold α. For example, the disturbance determination threshold γ may be set to a value obtained by switching reversely between positive and negative of the variation determination threshold α.

When it is determined that any disturbance did not occur (S111: No), the controller 31 performs a determination process of a trapping start (S113). To be specific, when the rotation speed difference Δω exceeds the variation determination threshold α to the negative side, the start of trapping is determined. When not exceeding, the start of trapping is not determined. When the start of trapping is determined (S113: Yes), the controller 31 advances to S115. When the start of trapping is not determined (S113: No), a default value is set to each of the accumulated value of the rotation speed difference Δω and the trapping determination threshold β (S114). To be specific, the accumulated value of the rotation speed difference Δω calculated at S110 is set to a default variation amount So of the rotation speed ω, whereas the trapping determination threshold β is returned to a usual value that is not increased. Thus, when it is determined that a period of the disturbance ends, the trapping determination threshold β is returned to the normal value; this re-starts a usual process.

Then, the variation amount S of the rotation speed ω is calculated (S115). To be specific, the controller 31 subtracts the accumulated value of the rotation speed difference Δω calculated at S114 from the default variation amount So of the rotation speed ω set at S110 just before determining the start of trapping, thereby calculating the variation amount S of the rotation speed ω (accumulated value of the rotation speed difference Δω) after the start of trapping. This permits certainly the calculation of the variation portion of the rotation speed (i.e., trapping load) due to trapping.

In the present embodiment, the variation amount of the rotation speed to after the start of trapping is calculated by calculating the difference of the variation amount from the reference value. When the start of trapping is not detected, the accumulated value of the rotation speed difference Δω may be initialized; when the start of trapping is detected, the accumulated value of the rotation speed difference Δω may not be initialized. This permits accumulation of the rotation speed difference Δω only after the start of trapping, thereby calculating the variation amount of the rotation speed ω.

Next, the controller 31 determines whether the variation amount S of the rotation speed ω calculated at S115 exceeds the trapping determination threshold β (S116). When it is determined that the variation amount S of the rotation speed ω exceeds the trapping determination threshold β (S116: Yes), the controller 31 performs a descent movement stop process (S118).

In contrast, when it is not determined that the variation amount S of the rotation speed ω exceeds the trapping determination threshold β (S116: No), the controller 31 advances to S117, where it is determined whether to receive a signal of an OFF of the down switch 4*a* or a signal of full open. When not receiving the signal of the OFF or the signal of full open (S117: No), the controller 31 returns to S108. When receiving the signal of the OFF or the signal of full open (S117: Yes), the descent movement stop process is executed (S118) and the present process ends. The descent movement stop of the window glass 11 is executed by the controller 31, which controls the supply of the electric power to the motor 20 to stop the movement of the motor 20 to stop the open movement (descent) of the window glass 11.

Figure 11:
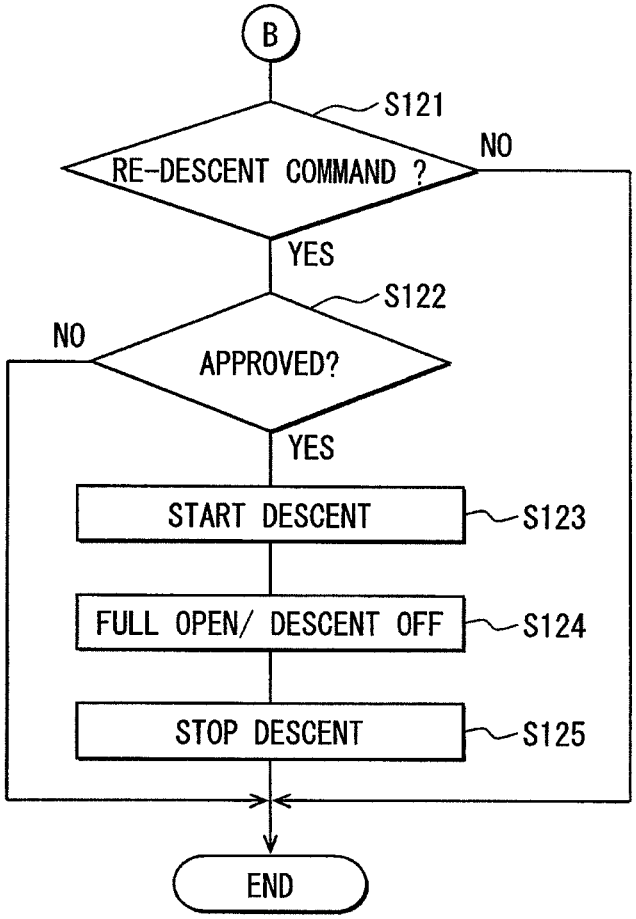
FIG. 11 is a flowchart diagram illustrating a process after re-open command according to the second embodiment.

After (i) the window glass 11 stops by the descent movement stop process at S106 or S118, and, then, (ii) the window glass 11 is not fully open, the controller 31 advances to S121 in FIG. 11, where the occurrence or non-occurrence of a re-descent movement command is determined. When the re-descent movement command occurs (S121: Yes), a re-descent movement approval determination is executed (S122). When the re-descent movement approval determination determines that a re-descent is approved (S122: Yes), the window glass 11 starts the descent movement (S123). The descent of the window glass 11 is performed until a signal of an OFF of the down switch 4*a* or a signal of full open is received. When an OFF signal due to OFF of the down switch 4*a* is issued, or a full open signal due to full open of the window glass 11 is issued (S124), the descent movement stop is made to stop the window glass 11 (S125).

When the re-descent movement command does not occur (S121: No), the present process ends with the window glass 11 remaining in the descent movement stop (S110). Thus, when the trapping determination is performed to thereby determine the trapping at S116, the descent movement of the window glass 11 stops at S118. However, in cases that the window glass 11 is not fully open, the re-descent approval determination may be made based on a predetermined condition even after the trapping is determined. In such a case, controlling the electric power supply to the driving device permits the window glass 11 to re-start the open movement.

When the re-descent movement command thereafter occurs (S121: Yes), the re-descent approval determination is executed at S122. The re-descent requires a predetermined condition, which may be a condition that a switch is manipulated within a predetermined period since the descent movement stop. For instance, when the down switch 4*a* is manipulated, a signal is inputted to the controller 31 as a down switch signal input. At this time, the re-descent approval determination is executed. In this case, a predetermined condition is that a switch manipulation is made for the open movement within a predetermined period (for example, less than 5 seconds) since the window glass 11 is stopped.

Thus, even when the window glass 11 is stopped, the down switch is manipulated promptly (i.e., the descent movement command is issued), the re-descent is approved. The descent movement of the window glass 11 thereby starts (S123). When an OFF manipulation is thereafter made to the down switch 4*a*, a down switch signal OFF is detected; when the window glass 11 is fully opened, a full open signal is detected (S124). The controller 31 then controls the supply of the electric power to the motor 20 to stop the movement of the motor 20 and the open movement (descent) of the window glass 11.

In general, the down switch 4*a* is usually provided near each corresponding window glass 11 among the window glasses 11, whereas switches for all the open-close members (i.e., all the window glasses 11) are provided at the driver seat. The down switch 4*a* of the present embodiment is provided as a down switch 4*a*, which is disposed near a corresponding window glass 11 and manually manipulated to thereby permit an open movement of the corresponding window glass 11. This permits secured open movement of only a window glass 11 that is desired to be opened; only a person or occupant near the corresponding window glass 11 can execute open movement by manipulating the down switch 4*a* and can determine whether to re-start open movement of that window glass 11. Safety check can be thus enhanced.

In the present embodiment, the predetermined conditions for the re-open mode in the re-descent approval determination may include the following four conditions (a to d).

a. The ignition key serving as an engine key of the vehicle is in an ON state.

b. The trapping detection is made in a window glass 11 near a seat of an occupant.

c. An elapsed time is within a predetermined period (for example, less than 3 to 8 seconds, preferably less than 5 seconds) since the window glass 11 is stopped after trapping detection is made.

d. A manual manipulation is made by an occupant, within the above-mentioned predetermined period, to the down switch 4*a* for opening the window glass 11 near the seat of the occupant (i.e., the descent movement command is issued).

Figure 12:
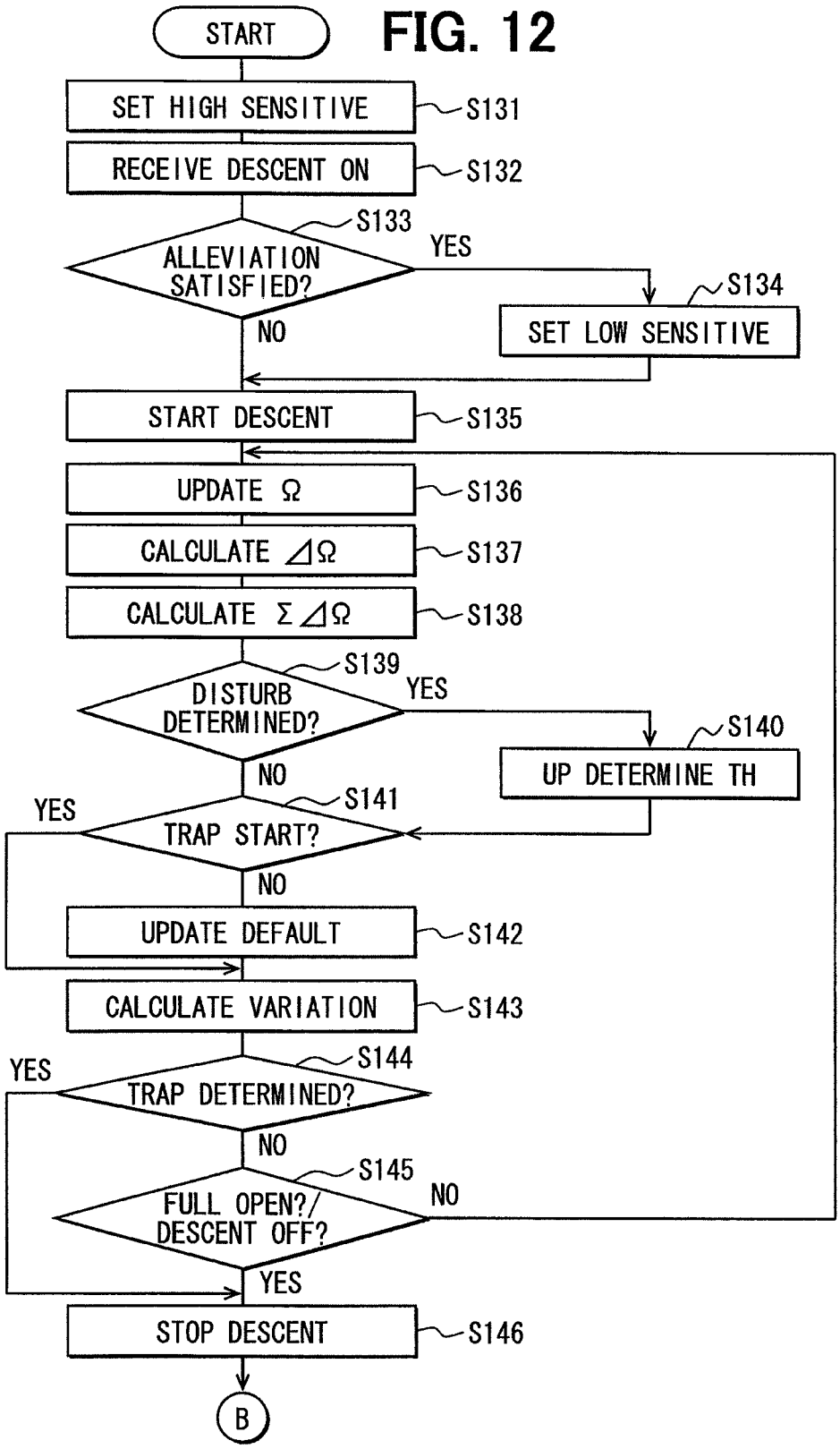
FIG. 12 is a flowchart diagram illustrating trapping determination and trapping detection alleviation according to the second embodiment.

While FIG. 10 indicates a flowchart to determine cancellation of the trapping detection, FIG. 12 indicates a flowchart to determine alleviation condition of trapping detection. That is, in FIG. 12, a low sensitivity threshold (insensitive) setting process is made so as to execute a trapping determination again using the setup that is less sensitive than the setup of the first trapping determination.

In this example of FIG. 12, the controller 31 performs a high sensitivity threshold (sensitive) setting process (S131). The high sensitivity threshold setting process at S131 sets to be equivalent to the above mentioned variation determination threshold α and trapping determination threshold β. After the setting process of the high sensitivity threshold (S131), an ON of the down switch 4*a* is inputted; thereby a down switch signal is inputted to the controller 31 (S132). When the down switch signal is inputted at S132, it is determined whether the alleviation condition of trapping detection is satisfied (S133), before actuating or using the trapping detection process. When the alleviation condition of trapping detection is satisfied (S133: Yes), the high sensitivity threshold setting performed at S131 is replaced by the low sensitivity threshold setting that makes the trapping detection less sensitive (S134). The low sensitivity threshold (insensitive) setting is to set the variation determination threshold α and the trapping determination threshold β to become large and provide a less sensitive state (i.e., insensitive state). This alleviates a threshold when determining trapping. It is noted that each of the variation determination threshold α and the trapping determination threshold β may be collectively referred to as a trapping detection condition (i.e., trapping detection threshold) or an open-stop condition (i.e., open-stop threshold) that is used in association with trapping detection for determining whether to stop open movement of the open-close member.

In contrast, when the alleviation condition of trapping detection is not satisfied (S133: No), the descent movement of the window glass 11 as an open-close member is started while the high sensitivity threshold set at S131 is maintained unchanged (S135). S135 to S146 is the same as S107 to S118 in FIG. 10; thus, the explanation thereof is omitted. As explained above, even when a foreign matter such as a belt molding is trapped or jammed, making the detection threshold insensitive permits the window glass 11 to open or descend without degrading manipulability.

Figure 13:
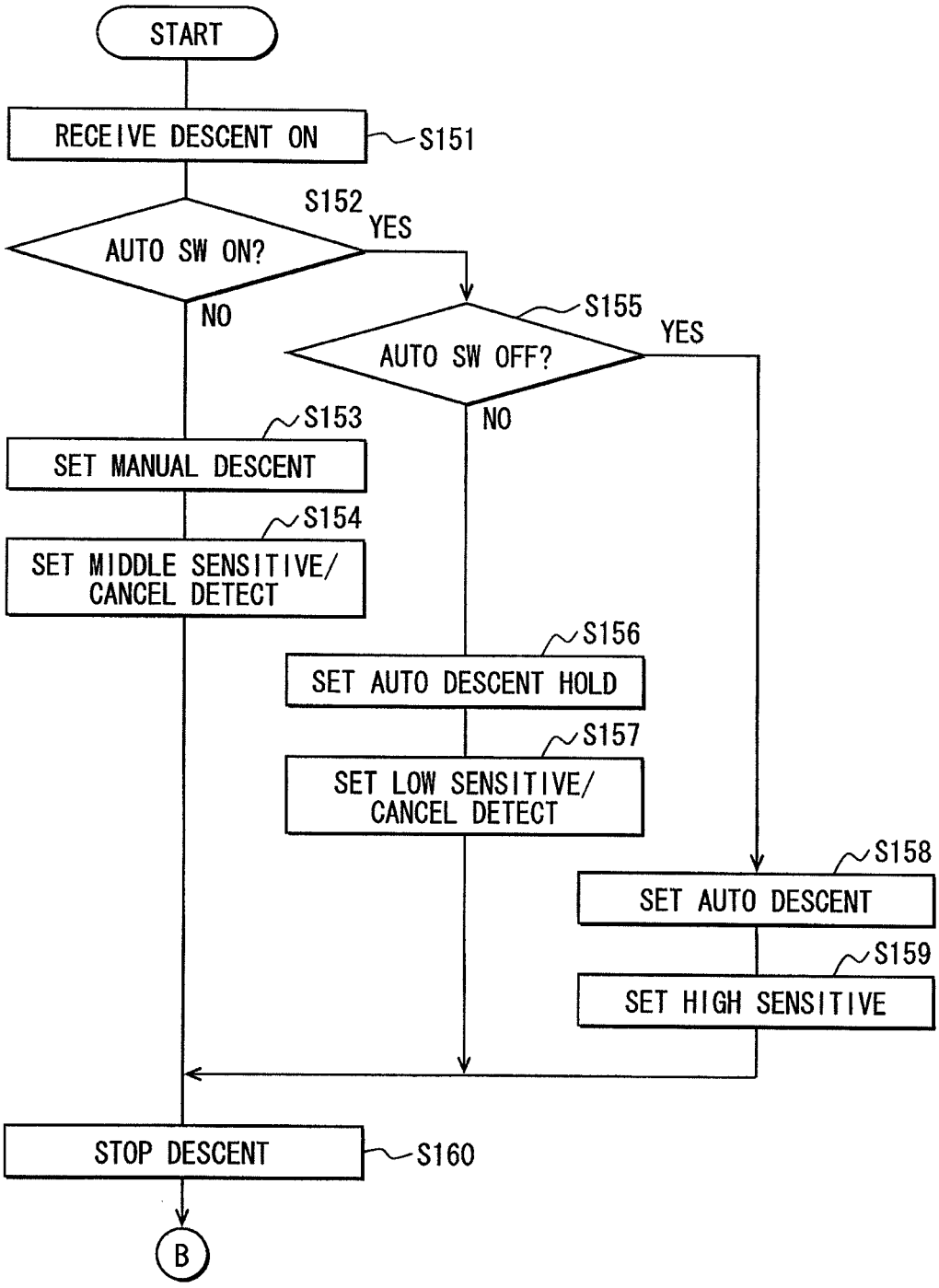
FIG. 13 is a flowchart diagram illustrating change of a threshold and trapping detection cancellation according to the second embodiment.

FIG. 13 indicates a flowchart of a process to change a threshold depending on switch input states or to cancel trapping detection as an example of recognition of predetermined condition. The following will explain examples of the trapping detection cancellation condition at S102 in FIG. 10 or the trapping detection alleviation condition at S133 in FIG. 12 with reference to the auto switch 4*c* that serves as a switch input state. As illustrated in FIG. 13, when manipulation is made to the switch 4, a down switch signal (descent movement command) is inputted to the controller 31 (S151). At this time, in order to determine whether the down switch signal is issued by the manipulation to the auto switch 4*c*, it is determined whether the auto switch 4*c* is turned into ON (S152).

When it is determined that the auto switch 4*c* is not turned into ON (S152: No), the controller 31 sets the movement of the window glass 11 as a manual descent movement (S153). Then, the trapping detection process is performed as a middle sensitivity threshold process or a trapping detection cancellation process at S154. The middle sensitivity threshold process is performed using an optional setup value between a low sensitivity threshold (insensitive) setup value and a high sensitivity threshold (sensitive) setup value. The middle sensitivity threshold process corresponds to the process of S107 to S117 in FIG. 10. In addition, the trapping detection cancellation process corresponds to the process of S103 to S106.

When the auto switch 4*c* is in the ON state (S152: Yes), it is then determined whether the auto switch 4*c* is one-time manipulated and returned in an OFF state or the auto switch 4*c* is continuously manipulated and still in an ON state (not in the OFF state) (S155). When the auto switch 4*c* is not in the OFF state (S155: No), it is determined that the auto switch 4*c* is being manipulated continuously and, further, intentionally. Thus, the controller 31 sets the movement of the window glass 11 to an auto descent holding movement (S156). Then, the trapping detection process is performed as a low sensitivity threshold process or detection cancellation process. The low sensitivity threshold process corresponds to the process of S134 and thereafter; the trapping detection cancellation process corresponds to the process of S103 and thereafter.

When it is determined that the auto switch 4*c* is now returned in the OFF state after one-time manipulation (S155: Yes), it is determined that the required movement is a usual descent movement of the window glass 11. The controller 31 sets the movement of the window glass 11 to an auto descent movement (S158). Then, the trapping detection process is performed as the high sensitivity threshold process, which corresponds to the process of S131 to S145. The window glass 11 descends after S154, S157, S159 and stops when a descent stop signal is received (S160).

Thus, in the present embodiment, the controller 31 performs the change of the trapping detection threshold, or trapping detection cancellation based on the switch input state. This secures the safety during the vehicle traveling while giving priority to manipulability of the switches such as a manual manipulation. Without degrading manipulability even when a foreign matter such as a belt molding is trapped or jammed, the window glass 11 can be moved downward or opened. In addition, the above processes may be applied to the pinching detection during the ascent of the window glass 11. That is, even when the window glass cannot be closed due to a mis-detection of a foreign matter being pinched by the window glass ascending, the pinching detection threshold setup values may be changed so as to take measure to the mis-detection of pinching.

In the example indicated in FIG. 13, the switch input state is used as the predetermined condition. There is no need to be limited thereto. The predetermined condition may further include the following: an operation signal or a descent movement command executed by switch manipulation within a predetermined period since issuance of the stop signal for the window glass 11 or since trapping detection; an open movement command of a wireless signal received from an outside of the vehicle where no occupant is present; a signal or a descent movement command, which is previously embedded and necessary for opening a window glass, such as a signal related to a submerged vehicle by the interlocking operating signal 7*c* from the ECU 7 of the vehicle body side, which is not an occupant compartment of the vehicle; a smoke emission operating signal 7*b* from the ECU 7; an open movement signal after pinching detection; a continual switch manipulation; a signal indicating a communication anomaly or communication failure; and a function having a high risk other than a trapping prevention function. The above signals or the like may be used for determining whether the cancellation condition of trapping detection is satisfied or the alleviation condition of trapping detection is satisfied, as shown in the flowcharts in FIGS. 10 to 12.

Aspects of the second embodiment of the present disclosure described herein are set out in the following clauses.

As a first aspect of the second embodiment, an open-close member control apparatus is provided to perform open movement or close movement of an open-close member based on manipulation of a switch or a signal from a control circuit in a vehicle. The apparatus includes a control device to perform trapping prevention, which prevents a foreign matter from being trapped to the open-close member that is under the open movement. The control device includes (i) a cancellation section to cancel a trapping detection, which is made to perform the trapping prevention, or (ii) an alleviation section to alleviate a condition of the trapping detection. In cases that the control device recognizes a predetermined condition when an open movement is required to the open-close member, the control device causes (i) the cancellation section to cancel the trapping detection or (ii) the alleviation section to alleviate the condition of the trapping detection.

As a second aspect of the second embodiment, an open-close member control apparatus is provided to prevent a foreign matter from being trapped to an open-close member that is driven to open based on manipulation of a switch or a signal from a control circuit in a vehicle. The apparatus includes: a driving device which drives open movement or close movement of the open-close member; a control device which controls actuation of the driving device; a movement detection device which outputs a movement state signal according to a movement state of the open-close member that is driven to open or close by the driving device; and a trapping detection section which performs trapping detection to detect trapping of the foreign matter to the open-close member based on the movement state signal. The trapping detection section further determines affirmatively or negatively the trapping of the foreign matter to the open-close member based on a result of comparing the movement state signal outputted by the movement detection device with a trapping determination threshold. The control device includes (i) a cancellation section to cancel the trapping detection or (ii) an alleviation section to alleviate the trapping determination threshold in determining affirmatively or negatively the trapping. When, under a predetermined condition, an open movement is required to the open-close member, the control device causes (i) the cancellation section to cancel the trapping detection or (ii) the alleviation section to alleviate the trapping determination threshold. Further, in other words, the alleviation section may alleviate the trapping determination threshold by making the trapping determination threshold less sensitive in determining affirmatively the trapping. Further, in other words, the alleviation section may make an open-stop condition less sensitive, the open-stop condition being for determining whether to stop open movement of the open-close member in the trapping detection or determination.

Under the configuration of the above first or second aspect, when the open-close member is certainly opened based on requirement to open, the trapping detection is cancelled or the detection condition is alleviated. Even when a sliding loss of the open-close member becomes great, the open movement of the open-close member can be executed.

As a third aspect being optional to the first or second aspect, the predetermined condition may be a signal requiring an open movement of the open-close member after the trapping detection. Under this configuration, even when misdetection of the trapping due to the increase in sliding loss arises, the open movement of the open-close member can be certainly carried out by switch manipulation for the second time.

As a fourth aspect being optional to the first or second aspect, the predetermined condition may be a signal issued by manipulation to the switch within a predetermined period since the trapping detection. Under this configuration, the open movement of the open-close member can be promptly carried out by reflecting the intention of the manipulator desiring the open movement of the open-close member.

As a fifth aspect being optional to the first or second aspect, the control device may recognize the predetermined condition based on the signal from the control circuit in the vehicle.

Under this configuration, more information can be acquired from an in-vehicle sensor which inputs signals to the control circuit in the vehicle in order to carry out the open movement certainly.

As a sixth aspect being optional to the fifth aspect, the signal from the control circuit in the vehicle may be a signal issued when the vehicle sinks in water.

As a seventh aspect being optional to the fifth aspect, the predetermined condition may be a command requiring an open movement of the open-close member based on a wireless signal from an outside of the vehicle. Under this configuration, when the movement of the open-close member is manipulated from an outside of the vehicle, the desired open movement can be carried out certainly. There is little trouble even if giving priority to the open movement since the vehicle compartment is vacant.

As an eighth aspect being optional to the fifth aspect, the control device may further include a pinching detection section to detect pinching; and the predetermined condition may be a command requiring an open movement of the open-close member after detecting the pinching. This permits the open movement to certainly release the pinching of the foreign matter.

Other Embodiments

Further, in the above embodiments, a vehicular power window apparatus is exemplified as an example of an open-close member control apparatus according to embodiments of the present disclosure. There is no need to be limited thereto. An open-close member of the open-close member control apparatus may not be limited to a glass material. The open-close member control apparatus may be applied to a sunroof open-close apparatus or a slide door open-close apparatus, whichever controls an open-close member to perform an open-close movement. Further, a manipulation switch includes down switches 4*a* and 6*a*, up switches 4*b* and 6*b*, and an auto switch 4*c*. Further, a manipulation switch includes an open switch, a close switch, or an auto switch; any switch is to drive an open-close member to open or close in any optional direction such as a longitudinal (forth-and-back) direction or a lateral (left-and-right) direction of the vehicle.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An opening and closing member control apparatus to prevent a foreign matter from being trapped to an opening and closing member that is driven to open based on manipulation of a manipulation switch, the apparatus comprising:

a driving device which drives open movement or close movement of the opening and closing member;

a control device which controls actuation of the driving device;

a movement detection device which outputs a movement state signal according to a movement state of the opening and closing member that is driven to open or close by the driving device; and a trapping detection section which performs trapping detection to detect trapping of the foreign matter to the opening and closing member based on the movement state signal, wherein:

the trapping detection section further determines affirmatively or negatively the trapping of the foreign matter to the opening and closing member based on a result of comparing the movement state signal outputted by the movement detection device with a trapping determination threshold;

the control device stops electric power supply to the driving device when the trapping detection section determines affirmatively the trapping of the foreign matter, permitting stop of open movement of the opening and closing member; and the control device starts, under a predetermined re-open condition, electric power supply to the driving device based on manipulation of the manipulation switch in a condition-alleviated state, permitting re-start of open movement of the opening and closing member, the condition-alleviated state using a second trapping detection condition that is alleviated from a first trapping detection condition, the first trapping detection condition being used before and when the trapping detection determines affirmatively the trapping.

2. The opening and closing member control apparatus according to claim 1, wherein the condition-alleviated state is a non-detection state that is a state that cancels the trapping detection.

3. The opening and closing member control apparatus according to claim 1, wherein the second trapping detection condition of the condition-alleviated state uses a second detection threshold that increases the trapping determination threshold value, in the trapping detection, more than a first detection threshold used by the first trapping detection condition.

4. The opening and closing member control apparatus according to claim 1, wherein the predetermined re-open condition is continued manual manipulation of the manipulation switch to send a signal, which requires open movement of the opening and closing member, to the control device.

5. The opening and closing member control apparatus according to claim 1, wherein the predetermined re-open condition is manipulation of the manipulation switch for open movement of the opening and closing member, the manipulation being made within a predetermined period since the opening and closing member is stopped after the trapping detection.

6. The opening and closing member control apparatus according to claim 1, wherein:

a plurality of the opening and closing members are provided and a plurality of the manipulation switches are provided;

one manipulation switch is disposed proximate to one opening and closing member for manipulating the one opening and closing member; and the predetermined re-open condition for the one opening and closing member is manipulation of the one manipulation switch disposed proximate to the one opening and closing member, the manipulation being for open movement of the one opening and closing member.

7. An opening and closing member control apparatus to perform open movement or close movement of an opening and closing member based on manipulation of a switch or a signal from a control circuit in a vehicle, the apparatus comprising a control device to perform trapping prevention, which prevents a foreign matter from being trapped to the opening and closing member that is under the open movement, the control device including a cancellation section to cancel a trapping detection, which is made to perform the trapping prevention, or an alleviation section to alleviate a condition of the trapping detection, wherein, in cases that the control device recognizes a predetermined condition when an open movement is required to the opening and closing member, the control device is configured to cause the cancellation section to cancel the trapping detection, and to cause the alleviation section to alleviate the condition of the trapping detection.

8. The opening and closing member control apparatus according to claim 7 wherein the predetermined condition is a signal requiring an open movement of the opening and closing member after the trapping detection.

9. The opening and closing member control apparatus according to claim 7, wherein the predetermined condition is a signal issued by manipulation to the switch within a predetermined period since the trapping detection.

10. The opening and closing member control apparatus according to claim 7, wherein the control device recognizes the predetermined condition based on the signal from the control circuit in the vehicle.

11. The opening and closing member control apparatus according to claim 10, wherein the signal from the control circuit in the vehicle is a signal issued when the vehicle sinks in water.

12. The opening and closing member control apparatus according to claim 10, wherein the predetermined condition is a command requiring an open movement of the opening and closing member based on a wireless signal from an outside of the vehicle.

13. The opening and closing member control apparatus according to claim 10, wherein:

the control device further includes a pinching detection section to detect pinching; and the predetermined condition is a command requiring an open movement of the opening and closing member after detecting the pinching.

14. An opening and closing member control apparatus to prevent a foreign matter from being trapped to an opening and closing member that is driven to open based on manipulation of a switch or a signal from a control circuit in a vehicle, the apparatus comprising:

a driving device which drives open movement or close movement of the opening and closing member;

a control device which controls actuation of the driving device;

a movement detection device which outputs a movement state signal according to a movement state of the opening and closing member that is driven to open or close by the driving device; and a trapping detection section which performs trapping detection to detect trapping of the foreign matter to the opening and closing member based on the movement state signal, wherein:

the trapping detection section further determines affirmatively or negatively the trapping of the foreign matter to the opening and closing member based on a result of comparing the movement state signal outputted by the movement detection device with a trapping determination threshold;

the control device includes a cancellation section to cancel the trapping detection or an alleviation section to alleviate the trapping determination threshold in determining affirmatively or negatively the trapping; and when, under a predetermined condition, an open movement is required to the opening and closing member, the control device causes (i) the cancellation section to cancel the trapping detection or (ii) the alleviation section to alleviate the trapping determination threshold.

15. The opening and closing member control apparatus according to claim 14, wherein the predetermined condition is a signal requiring an open movement of the opening and closing member after the trapping detection.

16. The opening and closing member control apparatus according to claim 14, wherein the predetermined condition is a signal issued by manipulation to the switch within a predetermined period since the trapping detection.

17. The opening and closing member control apparatus according to claim 14, wherein the control device recognizes the predetermined condition based on the signal from the control circuit in the vehicle.

18. The opening and closing member control apparatus according to claim 17, wherein the signal from the control circuit in the vehicle is a signal issued when the vehicle sinks in water.

19. The opening and closing member control apparatus according to claim 17, wherein the predetermined condition is a command requiring an open movement of the opening and closing member based on a wireless signal from an outside of the vehicle.

20. The opening and closing member control apparatus according to claim 17, wherein:

the control device further includes a pinching detection section to detect pinching; and the predetermined condition is a command requiring an open movement of the opening and closing member after detecting the pinching.

* * * * *